US011035256B2

(12) United States Patent
Onishi et al.

(10) Patent No.: US 11,035,256 B2
(45) Date of Patent: Jun. 15, 2021

(54) STEAM TURBINE SYSTEM

(71) Applicant: Mitsubishi Hitachi Power Systems, Ltd., Yokohama (JP)

(72) Inventors: Tomoyuki Onishi, Tokyo (JP); Katsuhisa Hamada, Yokohama (JP)

(73) Assignee: MITSUBISHI POWER, LTD., Yokohama (JP)

( * ) Notice: Subject to any disclaimer, the term of this patent is extended or adjusted under 35 U.S.C. 154(b) by 19 days.

(21) Appl. No.: 16/497,618

(22) PCT Filed: Jul. 11, 2018

(86) PCT No.: PCT/JP2018/026177
§ 371 (c)(1),
(2) Date: Sep. 25, 2019

(87) PCT Pub. No.: WO2019/013250
PCT Pub. Date: Jan. 17, 2019

(65) Prior Publication Data

US 2021/0108538 A1 Apr. 15, 2021

(30) Foreign Application Priority Data

Jul. 13, 2017 (JP) ..... JP2017-137198

(51) Int. Cl.
*F01D 25/24* (2006.01)
*F01D 25/26* (2006.01)
*F01D 25/30* (2006.01)

(52) U.S. Cl.
CPC ..... *F01D 25/26* (2013.01); *F01D 25/24* (2013.01); *F01D 25/30* (2013.01); *F05D 2220/31* (2013.01); *F05D 2240/14* (2013.01)

(58) Field of Classification Search
CPC ..... F01D 25/30; F01D 25/24; F05D 2250/73; F05D 2250/52; B65G 1/137
See application file for complete search history.

(56) References Cited

U.S. PATENT DOCUMENTS 4,102,598 A 7/1978 Stock et al.
5,779,435 A * 7/1998 Lageder ..... F01D 25/24 184/106

(Continued)

FOREIGN PATENT DOCUMENTS

DE 2650131 A1 5/1977
EP 3299592 A1 3/2018

(Continued)

OTHER PUBLICATIONS

JP-2015124634-A English Translation (Year: 2015).*

(Continued)

*Primary Examiner* — Shafiq Mian
(74) *Attorney, Agent, or Firm* — Westerman, Hattori, Daniels & Adrian, LLP

(57) ABSTRACT

This steam turbine system is provided with a first support rod (41) which is disposed in an outer casing (33) and extends in one direction. The first support rod (41) includes a first end (41A) which is connected to a surface, of an inner surface (45*a*) of an upper half of an end plate (45), on a first side in a lateral direction of an axial line of a rotor. The first support rod (41) includes a second end (41B) which is connected to an inner surface (48*a*) of a ceiling plate (48) which is disposed further on a second side in the lateral direction of the outer casing (33) than the first end (41A).

16 Claims, 13 Drawing Sheets

(56) References Cited

U.S. PATENT DOCUMENTS

| | | | | |
|---|---|---|---|---|
| 8,777,565 | B2 * | 7/2014 | Kondo | F01D 25/265 415/213.1 |
| 2005/0106006 | A1 * | 5/2005 | Reigl | F01D 25/24 415/108 |
| 2008/0003102 | A1 * | 1/2008 | Peel | F02C 3/16 415/214.1 |
| 2011/0097201 | A1 * | 4/2011 | Gafner | F01D 25/26 415/200 |
| 2012/0183397 | A1 | 7/2012 | Mizumi et al. | |
| 2013/0213042 | A1 | 8/2013 | Schule et al. | |
| 2015/0267561 | A1 * | 9/2015 | Huber | F01D 25/26 415/214.1 |

FOREIGN PATENT DOCUMENTS

| | | | | |
|---|---|---|---|---|
| JP | 2010-223146 | A | | 10/2010 |
| JP | 2015-124634 | A | | 7/2015 |
| JP | 2015124634 | A | * | 7/2015 |
| JP | 2017096194 | A | * | 6/2017 |

OTHER PUBLICATIONS

JP-2017096194-A English Translation (Year: 2017).*
International Search Report dated Sep. 25, 2018, issued in counterpart application No. PCT/JP2018/026177, with English translation. (2 pages).
Written Opinion dated Sep. 25, 2018, issued in counterpart application No. PCT/JP2018/026177, with English translation. (9 pages).

* cited by examiner

STEAM TURBINE SYSTEM

TECHNICAL FIELD

The present invention relates to a steam turbine system.

This application claims priority based on JP 2017-137198 filed in Japan on Jul. 13, 2017, of which the contents are incorporated herein by reference.

BACKGROUND ART

In a power generation plant, a steam turbine system including a steam turbine is used. The steam turbine is provided with a turbine rotor configured to rotate, an inner casing, and an outer casing.

The inner casing includes, in an upper portion thereof, a steam introduction port into which steam is introduced. The inner casing houses the turbine rotor. The outer casing houses the inner casing. The outer casing guides the steam that worked in the inner casing to the outside. The outer casing is in a vacuum state.

Among steam turbines, there is known a steam turbine system of a side condenser type in which a condenser is disposed on a first side in a lateral direction of the outer casing (refer to Patent Document 1, for example).

The outer casing disclosed in Patent Document 1 includes a bottom plate, a ceiling plate, a curved plate, a pair of end plates, and an exhaust port.

The ceiling plate is disposed above the bottom plate, facing the bottom plate. The curved plate is disposed facing the exhaust port. The curved plate is integrally formed with one end of the ceiling plate and one end of the base plate.

The pair of end plates are disposed sandwiching the curved plate, the ceiling plate, and the bottom plate from an axial line direction of the turbine rotor. An opening for inserting the turbine rotor is formed in each of the pair of end plates.

In the steam turbine system disclosed in Patent Document 1, the steam that worked in the steam turbine is supplied to the condenser via the exhaust port formed on the first side in the lateral direction of the outer casing.

In a steam turbine system configured in this manner, it is possible to lower the height of a building and a level of a foundation and reduce cost compared to a steam turbine that discharges steam in the downward direction.

CITATION LIST

Patent Document

Patent Document 1: JP 2015-124634 A

SUMMARY OF INVENTION

Technical Problem

However, in the steam turbine system disclosed in Patent Document 1, as described above, an interior of the outer casing is in a vacuum state and may therefore become recessed due to the effect of external pressure.

Additionally, when a portion of the outer casing deforms in a direction toward the exhaust port by the steam in the outer casing being discharged from the exhaust port, there is a possibility of displacement of the outer casing and the inner casing in the lateral direction toward the exhaust port.

Therefore, an object of the present invention is to provide a steam turbine system capable of suppressing deformation of an outer casing and suppressing displacement of the outer casing and an inner casing in a lateral direction toward an exhaust port.

Solution to Problem

In order to solve the above-described problems, a steam turbine system according to an aspect of the present invention includes a steam turbine provided with a rotor that rotates about an axial line and extends in a horizontal direction, an inner casing that houses the rotor and allows steam to be introduced therein, and an outer casing that houses the inner casing, is provided with an exhaust port on a first side in a lateral direction, and is in a vacuum state in an interior thereof; a condenser disposed on the first side in the lateral direction of the outer casing and supplied with the steam via the exhaust port; and a first support rod provided inside the outer casing and extending in one direction. The outer casing includes an end plate facing the inner casing in an axial line direction serving as an extending direction of the axial line of the rotor, a ceiling plate disposed above the inner casing, extending along a horizontal plane, and connected to the end plate, a bottom plate disposed below the ceiling plate, extending along the horizontal plane, and connected to the end plate, and a curved plate facing the exhaust port in a direction intersecting the axial line, protruding in a direction separating from the exhaust port, and connected to an end of the ceiling plate and an end of the bottom plate disposed on a second side in the lateral direction of the outer casing, as well as the end plate. The first support rod includes a first end connected to a surface, of an inner surface of an upper half of the end plate, positioned on the first side in the lateral direction of the axial line, and a second end connected to an inner surface of the ceiling plate disposed further on the second side in the lateral direction of the outer casing than the first end.

According to the present invention, with provision of the first support rod having the configuration described above, the first support rod functions as a brace (support bar) between the inner surface of the end plate and the inner surface of the ceiling plate, making it possible to suppress deformation of the outer casing (specifically, the end plate and the ceiling plate) in which the interior is in a vacuum state.

Further, with provision of the first support rod having the configuration described above, when deformation occurs in which the end plate becomes recessed due to a pressure on an outer side of the outer casing being higher than a pressure inside the outer casing, a force resulting from the deformation of the end plate can be transmitted to the ceiling plate connected to the second end of the first support rod via the first end of the first support rod.

At this time, because the second end of the first support rod is disposed further on the second side in the lateral direction of the outer casing than the first end of the first support rod, the force transmitted to the ceiling plate includes a lateral component that acts in a direction from the first side in the lateral direction toward the second side in the lateral direction of the outer casing, and an upward component that acts in a direction that pushes the curved plate upward.

Thus, with the upward component of the force transmitted to the ceiling plate, it is possible to suppress deformation in which the ceiling plate becomes recessed due to the pressure on the outer side of the outer casing.

Further, a force generated when the steam inside the outer casing is discharged via the exhaust port (specifically, the force that attempts to move the outer casing and the inner casing in a direction from the second side in the lateral direction toward the first side in the lateral direction of the outer casing) can be weakened by the lateral component of the force transmitted to the ceiling plate.

That is, with provision of the first support rod having the configuration described above, deformation of the outer casing is suppressed, making it possible to suppress displacement of the outer casing and the inner casing in the lateral direction toward the exhaust port.

Further, the steam turbine system according to an aspect of the present invention described above may further include a second support rod provided inside the outer casing, extending in one direction, and including a first end connected to a surface, of the inner surface of the upper half of the end plate, positioned on the second side in the lateral direction of the axial line, and a second end connected to an inner surface of the curved plate positioned above the first end of the second support rod such that the second support rod is parallel with a vertical direction of the outer casing when viewed in an axial line direction.

Thus, with provision of the second support rod having the configuration described above, the second support rod functions as a brace between the inner surface of the end plate and the inner surface of the curved plate, making it possible to suppress deformation of the outer casing (specifically, the end plate and the curved plate) in which the interior is in a vacuum state.

Further, with provision of the second support rod having the configuration described above, when deformation occurs in which the end plate becomes recessed due to the pressure on the outer side of the outer casing being higher than the pressure inside the outer casing, a force resulting from the deformation of the end plate can be transmitted to an upper portion of the curved plate via the second support rod.

At this time, because the second support rod is disposed parallel with the vertical direction of the outer casing when viewed in the axial line direction, the force transmitted to the curved plate includes a lateral component that acts in a direction parallel with the axial line direction, and an upward component that acts in a direction that pushes the curved plate upward.

Accordingly, the force transmitted by the second support rod to the curved plate does not include a component that acts in the direction from the second side in the lateral direction toward the first side in the lateral direction (a component that moves the outer casing and the inner casing to the exhaust port side). As a result, displacement (displacement in the lateral direction) of the outer casing and the inner casing to the exhaust port side caused by provision of the second support rod can be suppressed.

Further, the steam turbine system according to an aspect of the present invention may further include a third support rod provided inside the outer casing and extending in one direction. The outer casing may face the curved plate in a direction intersecting the axial line, and further include a side plate connected to an end of the ceiling plate and an end of the bottom plate disposed on the first side in the lateral direction, as well as the end plate. The third support rod may include a first end connected to an inner surface of the side plate, and a second end connected to an inner surface of the ceiling plate positioned on the second side in the lateral direction of the first end of the third support rod.

With provision of the third support rod having the configuration described above, the third support rod functions as a brace between the inner surface of the side plate and the inner surface of the ceiling plate, making it possible to suppress deformation of the outer casing (specifically, the side plate and the ceiling plate) in which the interior is in a vacuum state.

Further, with provision of the third support rod having the configuration described above, when deformation occurs in which the side plate becomes recessed toward the curved plate side due to the pressure on the outer side of the outer casing being higher than the pressure inside the outer casing, a force resulting from the deformation of the side plate can be transmitted to the ceiling plate connected to the second end of the third support rod via the first end of the third support rod.

At this time, the force transmitted to the ceiling plate includes a lateral component that acts in a direction from the first side in the lateral direction toward the second side in the lateral direction of the outer casing, and an upward component that acts in a direction that pushes the ceiling plate upward.

Thus, with the upward component of the force transmitted to the ceiling plate, it is possible to suppress deformation in which the ceiling plate becomes recessed due to the pressure on the outer side of the outer casing.

Further, a force generated when the steam inside the outer casing is discharged via the exhaust port (specifically, the force that attempts to move the outer casing and the inner casing in a direction from the second side in the lateral direction toward the first side in the lateral direction of the outer casing) can be weakened by the lateral component of the force transmitted to the ceiling plate.

That is, with provision of the third support rod having the configuration described above, deformation of the outer casing is suppressed, making it possible to suppress displacement of the outer casing and the inner casing in the lateral direction toward the exhaust port.

Further, the steam turbine system according to an aspect of the present invention described above may further include a turbine frame disposed below the outer casing and configured to fix the bottom plate, and a fourth support rod provided inside the outer casing, extending in one direction, and including a first end connected to a surface, of an inner surface of a lower half of the end plate, positioned on the second side in the lateral direction of the axial line of the rotor, and a second end disposed further on the second side in the lateral direction of the outer casing than the first end of the fourth support rod and connected to an inner surface of the curved plate positioned below the first end of the fourth support rod.

However, in a state in which the bottom plate of the outer casing is fixed to the turbine frame, a fixed portion of the bottom plate of the outer casing and the turbine frame is a constraint point. Then, moments centered on the constraint point are generated in the outer casing in this state.

Specifically, a moment is generated in a direction from bottom to top on the curved plate side, a moment is generated in a direction from top to bottom on the exhaust port side, and a moment is generated in a direction from the second end in the lateral direction toward the first end in the lateral direction on the ceiling plate side.

With provision of the fourth support rod having the configuration described above, when deformation occurs in which the end plate becomes recessed in the axial line direction of the rotor due to the pressure on the outer side of the outer casing being higher than the pressure inside the outer casing, a force resulting from the deformation of the end plate can be transmitted to the lower portion of the curved plate connected to the second end of the fourth support rod via the first end of the fourth support rod.

At this time, the force transmitted to the lower end of the curved plate includes a lateral component that acts in a direction from the first side in the lateral direction toward the second side in the lateral direction, and a downward component that acts in a direction that pushes the curved plate downward.

Thus, with the downward component of the force transmitted to the lower portion of the curved plate, it is possible to suppress deformation in which the lower portion of the curved plate becomes recessed, and offset a portion of the moment in the direction from bottom to top generated on the curved plate side.

Further, a force generated when the steam inside the outer casing is discharged via the exhaust port (specifically, the force that attempts to move the outer casing and the inner casing in a direction from the second side in the lateral direction toward the first side in the lateral direction of the outer casing) can be weakened by the lateral component of the force transmitted to the lower portion of the curved plate.

That is, with provision of the fourth support rod having the configuration described above, deformation of the outer casing is suppressed, making it possible to suppress displacement of the outer casing and the inner casing in the lateral direction toward the exhaust port.

Further, the steam turbine system according to an aspect of the present invention described above may further include a turbine frame disposed below the outer casing and configured to fix the bottom plate, and a fifth support rod provided inside the outer casing and extending in one direction. The outer casing may include a reinforcement rib that protrudes upward from the bottom plate and includes an opposing surface facing an inner surface of the end plate. The fifth support rod may include a first end connected to a surface, of an inner surface of a lower half of the end plate, on the first side in the lateral direction of the axial line, and a second end connected to the opposing surface of the reinforcement rib positioned further on the second end side in the lateral direction of the outer casing than the first end of the fifth support rod, and above the first end of the fifth support rod.

With provision of the fifth support rod having the configuration described above, the fifth support rod functions as a brace between the inner surface of the end plate and the opposing surface of the reinforcement rib, making it possible to suppress deformation of the outer casing (specifically, the end plate) in which the interior is in a vacuum state.

Further, with provision of the fifth support rod having the configuration described above, when the end plate is deformed, becoming recessed toward the rotor, due to the pressure on the outer side of the outer casing being higher than the pressure inside the outer casing, a force resulting from the deformation of the end plate can be transmitted to the reinforcement rib connected to the second end of the fifth support rod via the first end of the fifth support rod.

At this time, the force transmitted to the reinforcement rib includes a lateral component that acts in a direction from the first side in the lateral direction toward the second side in the lateral direction, and an upward component that acts in a direction that pushes the reinforcement rib upward.

Thus, it is possible to reduce the moment in the direction from the top to the bottom that occurs on the exhaust port side by the upward component of the force transmitted to the reinforcement rib.

Further, a force generated when the steam inside the outer casing is discharged via the exhaust port (specifically, the force that attempts to move the outer casing and the inner casing in a direction from the second side in the lateral direction toward the first side in the lateral direction of the outer casing) can be weakened by the lateral component of the force transmitted to the reinforcement rib.

That is, with provision of the fifth support rod having the configuration described above, deformation of the outer casing is suppressed, making it possible to suppress displacement of the outer casing and the inner casing in the lateral direction toward the exhaust port.

Further, in the steam turbine system according to an aspect of the present invention described above, the fifth support rod may be inclined more gently than an inclination of the fourth support rod when viewed in the axial line direction.

Thus, by making the inclination of the fifth support rod more gentle than the inclination of the fourth support rod, it is possible to efficiently reduce the moments generated on the curved plate side and the exhaust port side.

In order to solve the above-described problems, a steam turbine system according to an aspect of the present invention includes a steam turbine provided with a rotor that rotates about an axial line and extends in a horizontal direction, an inner casing that houses the rotor and allows steam to be introduced therein, and an outer casing that houses the inner casing, is provided with an exhaust port on a first side in a lateral direction, and is in a vacuum state in an interior thereof; a condenser disposed on the first side in the lateral direction of the outer casing and supplied with the steam via the exhaust port; a turbine frame that supports the outer casing; and a first support rod provided inside the outer casing and extending in one direction. The outer casing includes an end plate facing the inner casing in an axial line direction serving as an extending direction of the axial line of the rotor, a ceiling plate disposed above the inner casing, extending along a horizontal plane, and connected to the end plate, a bottom plate disposed below the ceiling plate, extending along the horizontal plane, and connected to the end plate, and a curved plate facing the exhaust port in a direction intersecting the axial line of the rotor, protruding in a direction separating from the exhaust port, and connected to an end of the ceiling plate and an end of the bottom plate disposed on a second side in the lateral direction of the outer casing, as well as the end plate. The first support rod includes a first end connected to a surface, of an inner surface of a lower half of the end plate, positioned on the second side in the lateral direction of the axial line of the rotor, and a second end disposed further on the second side in the lateral direction of the outer casing than the first end of the first support rod, and connected to an inner surface of the curved plate positioned below the first end of the first support rod.

According to the present invention, with provision of the first support rod having the configuration described above, the first support rod functions as a brace (support bar) between the inner surface of the end plate and the inner surface of the curved plate, making it possible to suppress deformation of the outer casing (specifically, the end plate and the lower portion of the curved plate) in which the interior is in a vacuum state.

However, in a state in which the bottom plate of the outer casing is fixed to the turbine frame, a fixed portion of the bottom plate of the outer casing and the turbine frame is a constraint point. Then, moments centered on the constraint point are generated in the outer casing in this state.

Specifically, a moment is generated in a direction from bottom to top on the curved plate side, a moment is generated in a direction from top to bottom on the exhaust port side, and a moment is generated in a direction from the second end in the lateral direction toward the first end in the lateral direction on the ceiling plate side.

With provision of the first support rod having the configuration described above, when the end plate is deformed recessed due to the pressure on the outer side of the outer casing being higher than the pressure inside the outer casing, a force resulting from the deformation of the end plate can be transmitted to the lower portion of the curved plate connected to the second end of the first support rod via the first end of the first support rod.

At this time, the force transmitted to the lower end of the curved plate includes a lateral component that acts in a direction from the first side in the lateral direction toward the second side in the lateral direction, and a downward component that acts in a direction that pushes the curved plate downward.

Thus, with the downward component of the force transmitted to the lower portion of the curved plate, it is possible to suppress deformation in which the lower portion of the curved plate becomes recessed, and offset a portion of the moment in the direction from bottom to top generated on the curved plate side.

Further, a force generated when the steam inside the outer casing is discharged via the exhaust port (specifically, the force that attempts to move the outer casing and the inner casing in a direction from the second side in the lateral direction toward the first side in the lateral direction of the outer casing) can be weakened by the lateral component of the force transmitted to the lower portion of the curved plate.

That is, with provision of the first support rod having the configuration described above, deformation of the outer casing is suppressed, making it possible to suppress displacement of the outer casing and the inner casing in the lateral direction toward the exhaust port.

Further, the steam turbine system according to an aspect of the present invention described above may further include a second support rod provided inside the outer casing, and extending in one direction. The outer casing may further include a reinforcement rib protruding upward from the bottom plate and including an opposing surface facing the inner surface of the end plate. The second support rod may include a first end connected to a surface, of an inner surface of a lower half of the end plate, on the first side in the lateral direction of the axial line, and a second end connected to the opposing surface of the reinforcement rib positioned further on the second side in the lateral direction of the outer casing than the first end of the second support rod, and above the first end of the second support rod.

With provision of the second support rod having the configuration described above, the second support rod functions as a brace between an inner surface of the lower half of the end plate and the opposing surface of the reinforcement rib, making it possible to suppress deformation of the outer casing (specifically, the end plate) in which the interior is in a vacuum state.

Further, with provision of the second support rod having the configuration described above, when the end plate is deformed recessed due to the pressure on the outer side of the outer casing being higher than the pressure inside the outer casing, a force resulting from the deformation of the end plate can be transmitted to the reinforcement rib connected to the second end of the second support rod via the first end of the second support rod.

At this time, the force transmitted to the reinforcement rib includes a lateral component that acts in a direction from the first side in the lateral direction toward the second side in the lateral direction, and an upward component that acts in a direction that pushes the reinforcement rib upward.

Thus, it is possible to reduce the moment in the direction from the top to the bottom that occurs on the exhaust port side by the upward component of the force transmitted to the reinforcement rib.

Further, a force generated when the steam inside the outer casing is discharged via the exhaust port (specifically, the force that attempts to move the outer casing and the inner casing in a direction from the second side in the lateral direction toward the first side in the lateral direction of the outer casing) can be weakened by the lateral component of the force transmitted to the reinforcement rib.

That is, with provision of the second support rod having the configuration described above, deformation of the outer casing is suppressed, making it possible to suppress displacement of the outer casing and the inner casing in the lateral direction toward the exhaust port.

Further, in the steam turbine system according to an aspect of the present invention described above, the second support rod may be inclined more gently than an inclination of the first support rod when viewed in the axial line direction.

Thus, by making the inclination of the second support rod including the first end connected to the inner surface of the end plate more gentle than the inclination of the first support rod including the first end connected to the inner surface of the lower half of the curved plate, it is possible to efficiently reduce the moments generated on the curved plate side and the exhaust port side.

Further, the steam turbine system according to an aspect of the present invention described above may further include a third support rod provided inside the outer casing, extending in one direction, and including a first end connected to a surface, of an inner surface of an upper half of the end plate, on the first side in the lateral direction of the axial line of the rotor, and a second end connected to an inner surface of the ceiling plate disposed further on the second side in the lateral direction of the outer casing than the first end.

Thus, with provision of the third support rod having the configuration described above, the third support rod functions as a brace (support rod) between the inner surface of the end plate and the inner surface of the ceiling plate, making it possible to suppress deformation of the outer casing (specifically, the end plate and the ceiling plate) in which the interior is in a vacuum state.

Further, with provision of the third support rod having the configuration described above, when deformation occurs in which the end plate becomes recessed due to the pressure on the outer side of the outer casing being higher than the pressure inside the outer casing, a force resulting from the deformation of the end plate can be transmitted to the ceiling plate connected to the second end of the third support rod via the first end of the third support rod.

At this time, because the second end of the third support rod is disposed further on the second side in the lateral direction of the outer casing than the first end of the third support rod, the force transmitted to the ceiling plate includes a lateral component that acts in a direction from the first side in the lateral direction toward the second side in the lateral direction of the outer casing, and an upward component that acts in a direction that pushes the curved plate upward.

Thus, with the upward component of the force transmitted to the ceiling plate, it is possible to suppress deformation in which the ceiling plate becomes recessed due to the pressure on the outer side of the outer casing.

Further, a force generated when the steam inside the outer casing is discharged via the exhaust port (specifically, the force that attempts to move the outer casing and the inner casing in a direction from the second side in the lateral direction toward the first side in the lateral direction of the outer casing) can be weakened by the lateral component of the force transmitted to the ceiling plate.

That is, with provision of the third support rod having the configuration described above, deformation of the outer casing is suppressed, making it possible to suppress displacement of the outer casing and the inner casing in the lateral direction toward the exhaust port.

Further, the steam turbine system according to an aspect of the present invention described above may further include a fourth support rod provided inside the outer casing, extending in one direction, and including a first end connected to a surface, of an inner surface of an upper half of the end plate, on the second side in the lateral direction of the axial line, and a second end connected to an inner surface of a lower half of the curved plate such that the fourth support rod is parallel with the vertical direction of the outer casing when viewed in the axial line direction.

Thus, with provision of the fourth support rod having the configuration described above, the fourth support rod functions as a brace between the inner surface of the end plate and the inner surface of the curved plate, making it possible to suppress deformation of the outer casing (specifically, the end plate and the curved plate) in which the interior is in a vacuum state.

Further, with provision of the fourth support rod having the configuration described above, when deformation occurs in which the end plate becomes recessed due to the pressure on the outer side of the outer casing being higher than the pressure inside the outer casing, a force resulting from the deformation of the end plate can be transmitted to an upper portion of the curved plate via the fourth support rod.

At this time, because the fourth support rod is disposed parallel with the vertical direction of the outer casing when viewed in the axial line direction, the force transmitted to the curved plate includes a lateral component that acts in a direction parallel with the axial line direction, and an upward component that acts in a direction that pushes the curved plate upward.

Accordingly, the force transmitted by the fourth support rod to the curved plate does not include a component that acts in the direction from the second side in the lateral direction toward the first side in the lateral direction (a component that moves the outer casing and the inner casing to the exhaust port side). As a result, displacement (displacement in the lateral direction) of the outer casing and the inner casing to the exhaust port side caused by the provision of the fourth support rod can be suppressed.

Further, the steam turbine system according to an aspect of the present invention may further include a fifth support rod provided inside the outer casing and extending in one direction. The outer casing may further include a side plate facing the curved plate and connected to an end of the ceiling plate disposed on the first side in the lateral direction, an end of the bottom plate disposed on the first side in the lateral direction, and the end plate. The fifth support rod may include a first end connected to an inner surface of the side plate, and a second end connected to an inner surface of the ceiling plate positioned on the second side in the lateral direction of the first end of the fifth support rod.

Thus, with provision of the fifth support rod having the configuration described above, the fifth support rod functions as a brace between the inner surface of the side plate and the inner surface of the ceiling plate, making it possible to suppress deformation of the outer casing (specifically, the side plate and the ceiling plate) in which the interior is in a vacuum state.

Further, with provision of the fifth support rod having the configuration described above, when deformation occurs in which the side plate becomes recessed on the curved plate side due to the pressure on the outer side of the outer casing being higher than the pressure inside the outer casing, a force resulting from the deformation of the side plate can be transmitted to the ceiling plate connected to the second end of the fifth support rod via the first end of the fifth support rod.

At this time, the force transmitted to the ceiling plate includes a lateral component that acts in a direction from the first side in the lateral direction toward the second side in the lateral direction of the outer casing, and an upward component that acts in a direction that pushes the ceiling plate upward.

Thus, with the upward component of the force transmitted to the ceiling plate, it is possible to suppress deformation in which the ceiling plate becomes recessed due to the pressure on the outer side of the outer casing.

Further, a force generated when the steam inside the outer casing is discharged via the exhaust port (specifically, the force that attempts to move the outer casing and the inner casing in a direction from the second side in the lateral direction toward the first side in the lateral direction of the outer casing) can be weakened by the lateral component of the force transmitted to the ceiling plate.

That is, with provision of the fifth support rod having the configuration described above, deformation of the outer casing is suppressed, making it possible to suppress displacement of the outer casing and the inner casing in the lateral direction toward the exhaust port.

Further, in the steam turbine system according to an aspect of the present invention, the outer casing may include a side plate facing the exhaust port in a direction intersecting the axial line, two of the exhaust ports may be provided in the axial line direction, and the side plate may be disposed between the two exhaust ports.

Thus, the two end plates may be disposed facing each other in the axial line direction across the inner casing.

Further, in the steam turbine system according to an aspect of the present invention, two of the exhaust ports may be provided in the axial line direction, and the side plate may be disposed between the two exhaust ports.

Thus, the two exhaust ports may be provided in the axial line direction of the rotor, and the side plate may be disposed between the two exhaust ports.

Advantageous Effect of Invention

According to the present invention, it is possible to suppress deformation of the outer casing, and suppress displacement of the outer casing and the inner casing in the lateral direction toward the exhaust port.

DESCRIPTION OF EMBODIMENTS

Embodiments in which the present invention is applied will be described in detail below with reference to the drawings.

First Embodiment

Figure 1:
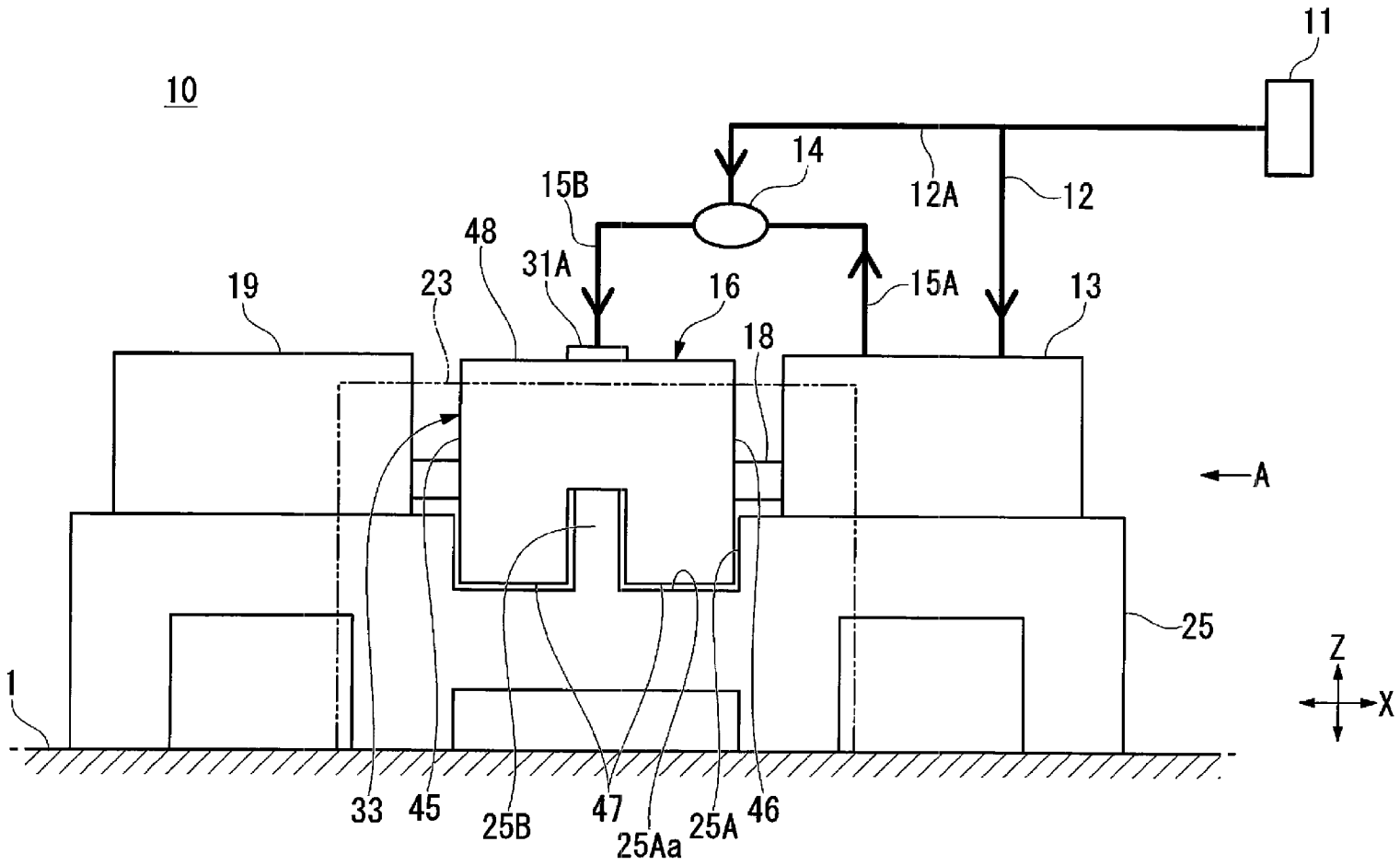
FIG. 1 is a diagram illustrating a schematic configuration of a steam turbine system according to a first embodiment of the present invention.

A steam turbine system 10 of the first embodiment will be described with reference to FIG. 1 and FIG. 2. In FIG. 1, a condenser 23 (on the front side of the paper surface) of a low-pressure steam turbine 16 illustrated in FIG. 1 is illustrated by a dotted line. Further, in FIG. 1, an intermediate shell 21 illustrated in FIG. 2 and an exhaust port 56 illustrated in FIG. 3 are not illustrated. In FIG. 1, an X direction indicates an axial line direction (direction of an axial line Ax) of a turbine rotor 18 (rotor), and a Z direction indicates a vertical direction.

Figure 2:
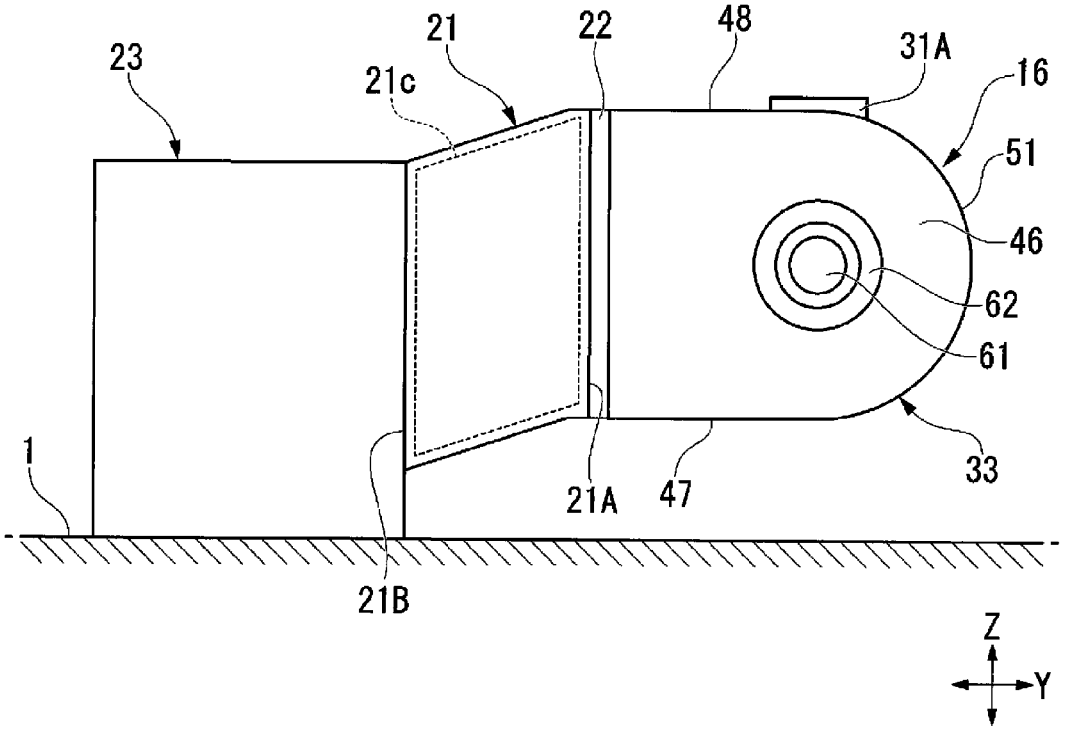
FIG. 2 is a side view of a low-pressure steam turbine and a condenser illustrated in FIG. 1, and an intermediate shell (not illustrated in FIG. 1), as viewed from A.
Figure 3:
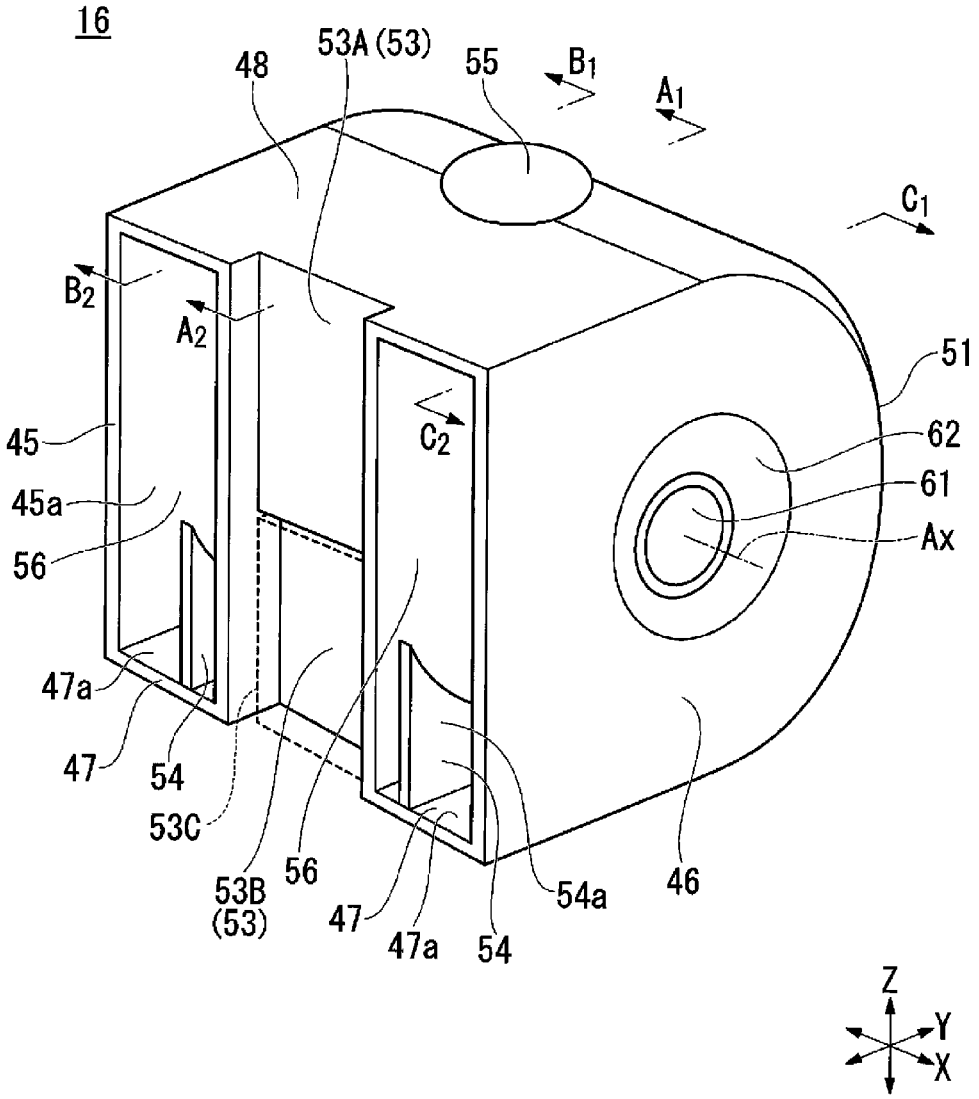
FIG. 3 is a perspective view illustrating a schematic configuration of the low-pressure steam turbine illustrated in FIG. 2.

In FIG. 2, a Y direction indicates a direction orthogonal to the X direction and the Z direction (a direction orthogonal to the axial line direction). In FIG. 2, common numerals are assigned to similar components to the structural bodies illustrated in FIG. 1.

The steam turbine system 10 of the first embodiment includes a steam generator 11, a steam supply line 12, a diverging line 12A, a high-pressure steam turbine 13, and a moisture separation heater 14, lines 15A, 15B, the low-pressure steam turbine 16, the turbine rotor 18, a generator 19, the intermediate shell 21, an expandable member 22, the condenser 23, and a turbine frame 25.

The steam generator 11 is connected to a first end of the steam supply line 12. The steam generator 11 generates high-pressure steam. The steam generator 11 supplies the high-pressure steam to the high-pressure steam turbine 13 via the steam supply line 12, and the moisture separation heater 14.

The steam supply line 12 is connected to the high-pressure steam turbine 13 at a second end. The steam supply line 12 supplies the high-pressure steam generated by the steam generator 11 to the high-pressure steam turbine 13.

The diverging line 12A diverges from the steam supply line 12. A leading end of the diverging line 12A is connected to a steam introduction port 31A of the low-pressure steam turbine 16.

The high-pressure steam turbine 13 is fixed on the turbine frame 25. The high-pressure steam turbine 13 houses a portion of the turbine rotor 18 extending in the X direction.

The moisture separation heater 14 separates and heats the moisture of the steam from the steam generator 11 and the high-pressure steam turbine 13.

The line 15A includes a first end connected to the high-pressure steam turbine 13, and a second end connected to the moisture separation heater 14. The line 15A supplies the moisture of the steam from the high-pressure steam turbine 13 to the moisture separation heater 14.

The line 15B includes a first end connected to the moisture separation heater 14, and a second end connected to the steam introduction port 31A of the low-pressure steam turbine 16. The line 15B supplies the heated steam to the steam introduction port 31A of the low-pressure steam turbine 16.

Figure 4:
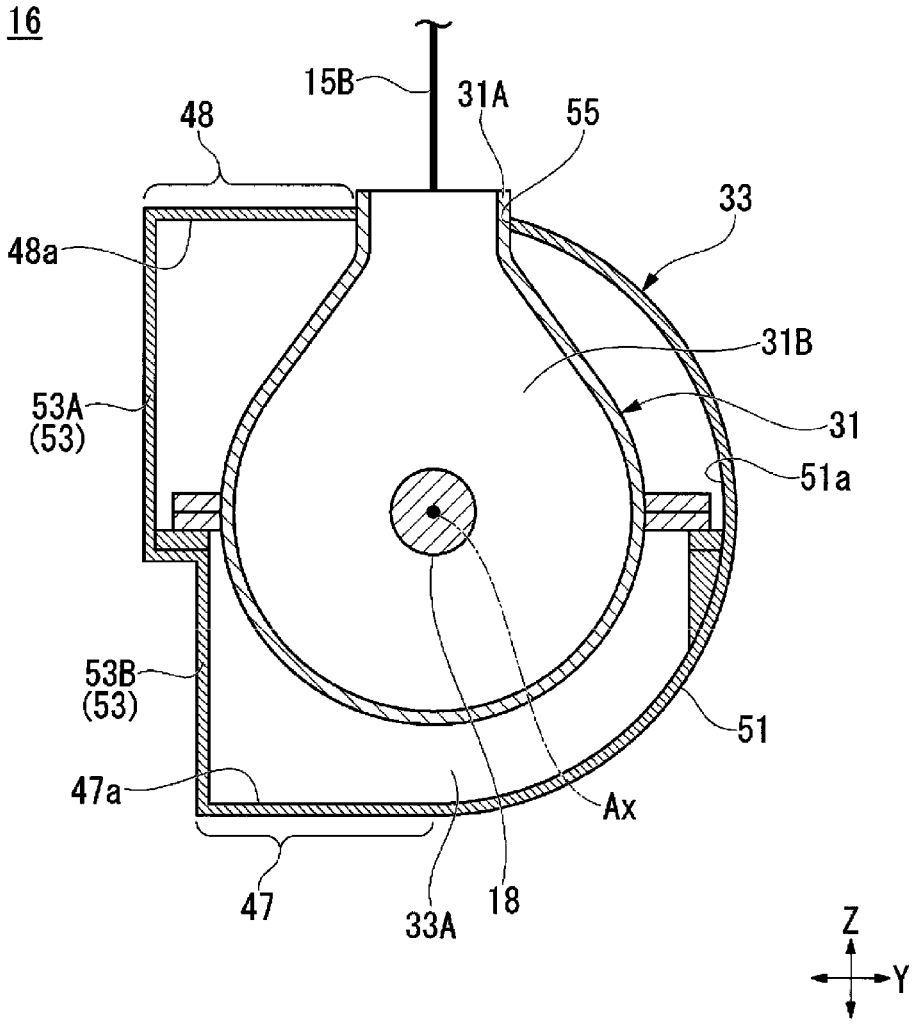
FIG. 4 is a cross-sectional view in the $A_1$-$A_2$ line direction of the low-pressure steam turbine illustrated in FIG. 3.
Figure 5:
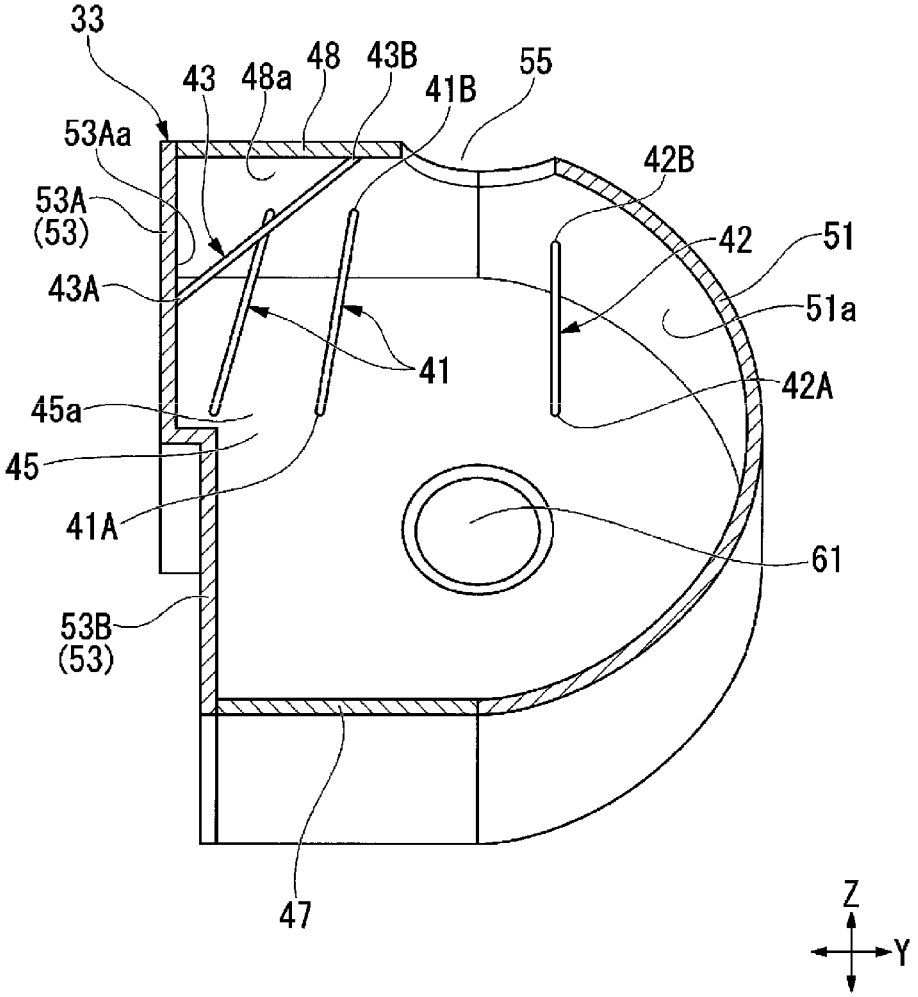
FIG. 5 is a perspective view of a cross section in the $B_1$-$B_2$ line direction of the low-pressure steam turbine illustrated in FIG. 3.
Figure 6:
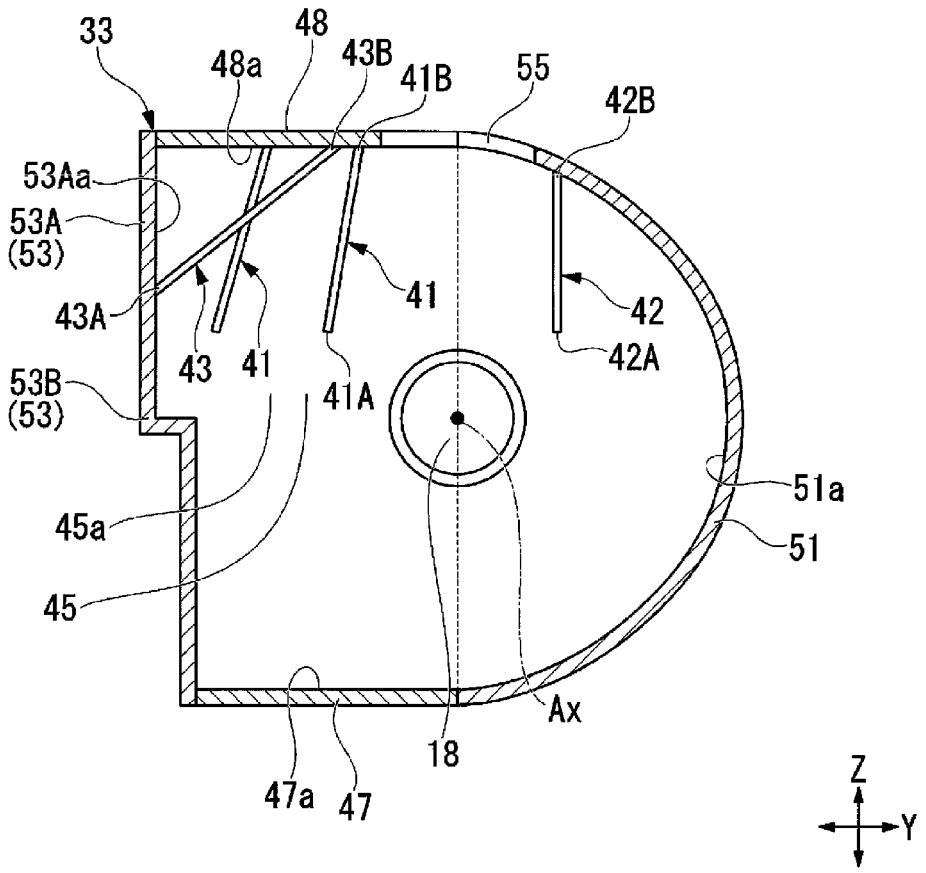
FIG. 6 is a diagram of a structural body illustrated in FIG. 5 as viewed in an axial line direction.
Figure 7:
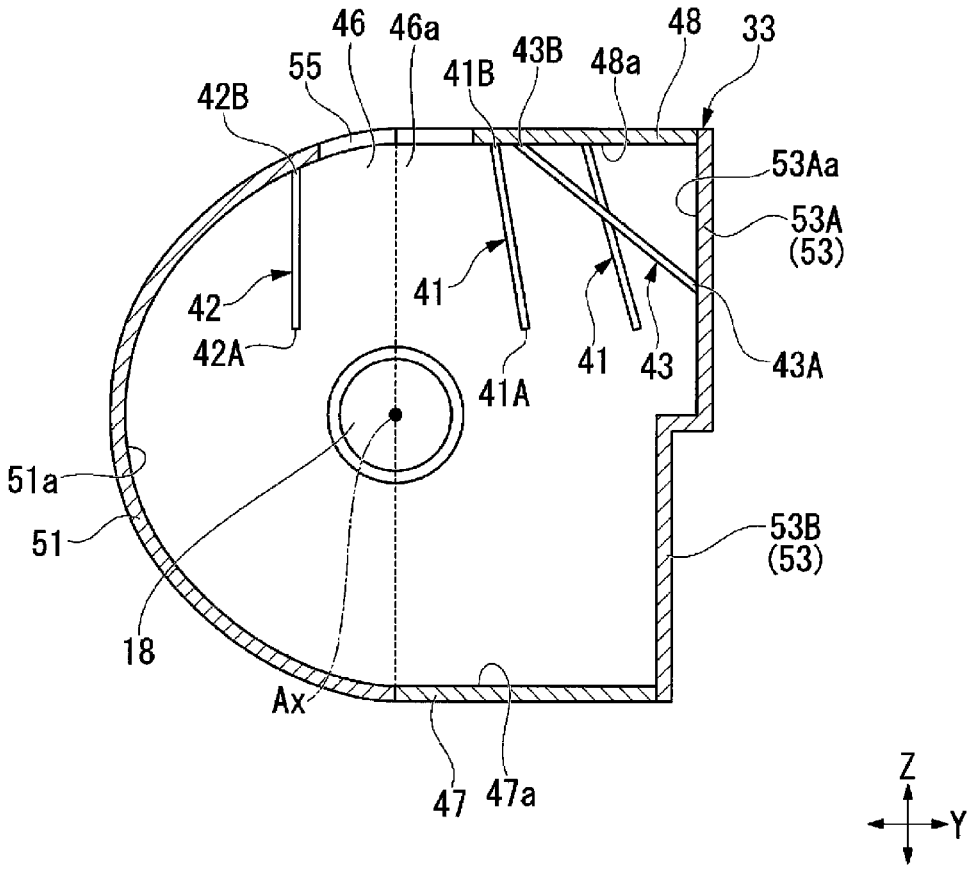
FIG. 7 is a cross-sectional view in the $C_1$-$C_2$ line direction of the low-pressure steam turbine illustrated in FIG. 3.

The low-pressure steam turbine 16 will be described with reference to FIG. 1 to FIG. 7. For the structural bodies illustrated in FIG. 1 to FIG. 7, common reference signs are assigned to similar components. In FIG. 3, the turbine rotor 18 (refer to FIG. 1) included in the low-pressure steam turbine 16 is not illustrated. In FIG. 4, a first support rod 41, a second support rod 42, and a third support rod 43 illustrated in FIG. 5 to FIG. 7 are not illustrated. In FIG. 4, for convenience of explanation, the line 15B that is not a constituent component of the low-pressure steam turbine 16 is illustrated.

In FIGS. 4, 6, and 7, Ax denotes an axial line of the turbine rotor 18 extending in the X direction illustrated in FIG. 1 (hereinafter referred to as "axial line Ax"). The axial line Ax is parallel with the X direction. Furthermore, in the following description, the direction in which the axial line Ax extends is referred to as an axial line Ax direction. In FIG. 5 to FIG. 7, for convenience of explanation, an inner casing 31 illustrated in FIG. 4 is not illustrated. Further, FIG. 6 and FIG. 7, for convenience of explanation, illustrate the turbine rotor 18 not illustrated in FIG. 3.

Note that, in the first embodiment, an example is given of a case in which the low-pressure steam turbine 16 is a double-flow type (multi-flow type) steam turbine.

Further, in the present invention, a "first side in the lateral direction" refers to the side in which the exhaust port 56 is formed in an outer casing 33. Further, a "second side in the lateral direction" refers to the side in which a curved plate 51 is disposed in the outer casing 33.

The low-pressure steam turbine 16 is disposed between the high-pressure steam turbine 13 and the generator 19 in the X direction. The low-pressure steam turbine 16 is fixed on the turbine frame 25.

The low-pressure steam turbine 16 includes the turbine rotor 18, the inner casing 31, the outer casing 33, the first support rod 41, the second support rod 42, and the third support rod 43.

The turbine rotor 18 extends in the X direction and rotates about the axial line Ax. Note that the turbine rotor 18 needs only extend in a horizontal direction parallel with the X direction or the Y direction, and thus an extending direction of the turbine rotor 18 is not limited to the X direction. In the first embodiment, description is given using a case in which the turbine rotor 18 extends in the X direction as an example.

The turbine rotor 18 passes through the inner casing 31 and the outer casing 33 in the X direction. A first end side of the turbine rotor 18 disposed on the high-pressure steam turbine 13 side is disposed inside the high-pressure steam turbine 13, and a second end side disposed on the generator 19 side is disposed inside the generator 19.

Multistage blade rows (not illustrated) disposed in the X direction are respectively provided to a portion of the turbine rotor 18 disposed inside the high-pressure steam turbine 13 and a portion of the turbine rotor 18 disposed inside the low-pressure steam turbine 16.

The turbine rotor 18 is supported in a state rotatable about the axial line by a rotor bearing (not illustrated) disposed on an outer side of the outer casing 33.

The inner casing 31 is fixed to the outer casing 33 in a state of being housed inside the outer casing 33. The inner casing 31 partitions a space 31B in the interior thereof. The inner casing 31 includes the steam introduction port 31A connected to the second end of the line 15B at an upper end.

The steam introduction port 31A introduces heated steam into the space 31B via the line 15B. After the steam introduced into the space 31B has passed through a gap between the inner casing 31 and the turbine rotor 18 and worked, the steam is discharged in the X direction (specifically, in the direction from the inner casing 31 toward the high-pressure steam turbine 13 and in the direction from the inner casing 31 toward the generator 19) inside the outer casing 33.

The outer casing 33 partitions a space 33A in the interior thereof. The space 33A is in a vacuum state. A pressure on the outer side of the outer casing 33 is higher than a pressure in the space 33A in the vacuum state.

The outer casing 33 includes a pair of end plates 45, 46 (two end plates), a bottom plate 47, a ceiling plate 48, the curved plate 51, a side plate 53, a reinforcement rib 54, an opening 55, and two of the exhaust ports 56.

The pair of end plates 45, 46 are disposed facing each other in the X direction across the inner casing 31. The pair of end plates 45, 46 each include an opening 61 for inserting the turbine rotor 18, and a cone portion 62. The openings 61 formed in the end plates 45, 46 are disposed facing each other in the X direction.

The cone portion 62 is a portion having a conical shape recessed toward the space 33A side. A rotor bearing (not illustrated) that rotatably supports the turbine rotor 18 is disposed adjacent to the cone portion 62.

The bottom plate 47 is disposed below the ceiling plate 48 and extends along a horizontal plane (a plane parallel with the X and Y directions). The bottom plate 47 is connected to lower ends of the pair of end plates 45, 46 and a lower end of the side plate 53.

The bottom plate 47 includes an inner surface 47*a* orthogonal to the Z direction. The inner surface 47*a* constitutes a portion of an inner surface of the outer casing 33. The bottom plate 47 is fixed to the turbine frame 25. A portion where the bottom plate 47 and the turbine frame 25 are connected serves as a constraint point.

The ceiling plate 48 is disposed above the inner casing 31 and extends along a horizontal plane (a plane parallel with the X and Y directions). The ceiling plate 48 is connected to upper ends of the pair of end plates 45, 46 and an upper end of the side plate 53. The ceiling plate 48 includes an inner surface 48*a* (lower surface) that faces the inner surface 47*a* of the bottom plate 47 and is parallel with the inner surface 47*a*. The inner surface 48*a* constitutes a portion of the inner surface of the outer casing 33.

The curved plate 51 is connected to an end of the ceiling plate 48 disposed on the second side in the lateral direction, an end of the bottom plate 47 disposed on the second side in the lateral direction, and the pair of end plates 45, 46 disposed on the second side in the lateral direction.

The curved plate 51 faces the exhaust ports 56 in the Y direction (the direction orthogonal to the axial line Ax of the turbine rotor 18). The curved plate 51 includes an inner surface 51*a* that faces the exhaust ports 56. The inner surface 51*a* is a curved surface.

Note that, in the first embodiment, an example is given of a case in which the curved plate 51 and the exhaust ports 56 face each other in a direction orthogonal to the axial line Ax, but the curved plate 51 and the exhaust ports 56 may be disposed facing each other in a direction intersecting the axial line Ax.

The curved plate 51 protrudes in a direction separating from the exhaust ports 56. When viewed in the direction of the axial line Ax, the curved plate 51 can have a semi-circular shape about the axial line Ax of the turbine rotor 18, for example.

Note that, in the first embodiment, a description is given using a case in which the shape of the curved plate 51 is semi-circular about the axial line Ax of the turbine rotor 18 as an example.

The side plate 53 is connected to an end of the ceiling plate 48 disposed on the first side in the lateral direction, an end of the bottom plate 47 disposed on the first side in the lateral direction, and the pair of end plates 45, 46 disposed on the first side in the lateral direction.

The side plate 53 includes an upper portion 53A, a lower portion 53B, and an insertion portion 53C. The upper portion 53A is disposed above the lower portion 53B and is connected to the ceiling plate 48. The upper portion 53A is disposed on the first side in the lateral direction of the lower portion 53B. In this way, the insertion portion 53C is formed below the upper portion 53A.

A support portion 25B of the turbine frame 25 is inserted into the insertion portion 53C. With the support portion 25B inserted into the insertion portion 53C, a lower surface of the upper portion 53A and an outer surface of the lower portion 53B come into contact with the support portion 25B.

A plurality of the reinforcement ribs 54 are provided on the inner surface 47*a* of the bottom plate 47. The plurality of reinforcement ribs 54 are arranged in the X direction spaced apart from each other. The reinforcement rib 54 is a plate member extending in the Y direction.

A plurality of the reinforcement ribs 54 are also provided on the inner surface 47*a* of the bottom plate 47 in correspondence with the exhaust ports 56. The reinforcement ribs 54 face a portion of the end plates 45, 46. The reinforcement ribs 54 provided to the exhaust ports 56 each include an opposing surface 54*a* that faces the inner surface (inner surface 45*a* or inner surface 46*a*) of one end plate (end plate 45 or end plate 46) of the end plates 45, 46 disposed adjacent to the reinforcement rib 54.

The opening 55 is provided at a boundary portion between the ceiling plate 48 and the curved plate 51. The steam introduction port 31A of the inner casing 31 is disposed in the opening 55.

One of the exhaust ports 56 is provided on each side of the side plate 53 sandwiching the side plate 53 in the X direction. The two exhaust ports 56 protrude to the first side in the lateral direction of the upper portion 53A of the side plate 53. The exhaust ports 56 discharge the steam guided from the inner casing 31 into the outer casing 33 to outside the outer casing 33.

The exhaust ports 56 are connected to the intermediate shell 21 via the expandable member 22. The exhaust ports 56 supply steam to the condenser 23 via the intermediate shell 21. The shape of the exhaust ports 56 can be, for example, a quadrangle.

The first support rod 41 is a support rod extending in one direction, and four first support rods 41 are provided inside the outer casing 33 (refer to FIGS. 6 and 7). Of the first support rods 41, first ends 41A of two first support rods 41 are connected to a surface, of the inner surface 45*a* of an upper half of the end plate 45, on the first side in the lateral direction of the axial line Ax of the turbine rotor 18 (refer to FIG. 6).

Second ends 41B of the two first support rods 41 are connected to the inner surface 48*a* of the ceiling plate 48 disposed further on the second side in the lateral direction of the outer casing 33 than the first ends 41A. The two first support rods 41 are arranged spaced apart in the Y direction.

The first ends 41A of the remaining two first support rods 41 are connected to a surface, of the inner surface 46*a* of an upper half of the end plate 46, on the first side in the lateral direction of the axial line Ax of the turbine rotor 18 (refer to FIG. 7). The second ends 41B of these remaining two first support rods 41 are connected to the inner surface 48*a* of the ceiling plate 48 disposed further on the second side in the lateral direction of the outer casing 33 than the first ends 41A. The remaining two first support rods 41 are arranged spaced apart.

With provision of the first support rods 41 having such a configuration, the first support rods 41 function as braces (support rods) between the inner surfaces 45*a*, 46*a* of the end plates 45, 46 and the inner surface 48*a* of the ceiling plate 48, making it possible to suppress deformation of the outer casing 33 (specifically, the end plates 45, 46 and the ceiling plate 48) in which the interior is in a vacuum state.

Further, with provision of the first support rods 41 having the configuration described above, when deformation occurs in which the end plates 45, 46 become recessed due to the pressure on the outer side of the outer casing 33 being higher than the pressure inside the outer casing 33, a force resulting from the deformation of the end plates 45, 46 can be transmitted to the ceiling plate 48 connected to the second ends 41B of the first support rods 41 via the first ends 41A of the first support rods 41.

At this time, because the second ends 41B of the first support rods 41 are disposed further on the second side in the lateral direction of the outer casing 33 than the first ends 41A of the first support rods 41, the force transmitted to the ceiling plate 48 includes a lateral component (hereinafter referred to as "lateral component S1") that acts in a direction from the first side in the lateral direction toward the second side in the lateral direction of the outer casing 33, and an upward component (hereinafter referred to as "upward component U1") that acts in a direction that pushes the curved plate 51 upward.

Thus, with the upward component U1 of the force transmitted to the ceiling plate 48, it is possible to suppress deformation in which the ceiling plate 48 becomes recessed due to the pressure on the outer side of the outer casing 33.

Further, a force generated when the steam inside the outer casing 33 is discharged via the exhaust ports 56 (specifically, the force that attempts to move the outer casing 33 and the inner casing 31 in a direction from the second side in the lateral direction toward the first side in the lateral direction of the outer casing 33) can be weakened by the lateral component S1 of the force transmitted to the ceiling plate 48.

That is, with provision of the first support rods 41 having the configuration described above, deformation of the outer casing 33 is suppressed, making it possible to suppress displacement of the outer casing 33 and the inner casing 31 in the lateral direction toward the exhaust ports 56.

Note that, in FIGS. 5 to 7, description has been made using an example in which four first support rods 41 are provided inside the outer casing 33. The number of the first support rods 41 provided inside the outer casing 33, however, may be one or more, and is not limited to four. That is, the first support rod 41 may be provided on only one end plate of the pair of end plates 45, 46.

The second support rod 42 is a support rod that extends in one direction. Two of the second support rods 42 are provided inside the outer casing 33 with both ends connected to the inner surface of the outer casing 33.

A first end 42A of one of the second support rods 42 is connected to a surface, of the inner surface 45*a* of the upper half of the end plate 45, on the second side in the lateral direction of the axial line Ax of the turbine rotor 18.

A second end 42B of one of the second support rods 42 is connected to the inner surface 51*a* of the curved plate 51 positioned above the first end 42A of the second support rod 42 such that the second support rod 42 is parallel with the Z direction (vertical direction) of the outer casing 33 when viewed in the axial line Ax direction (the state illustrated in FIG. 6).

The first end 42A of other of the second support rods 42 is connected to a surface, of the inner surface 45*a* of the upper half of the end plate 46, on the second side in the lateral direction of the axial line Ax of the turbine rotor 18.

The second end 42B of the other second support rod 42 is connected to the inner surface 51*a* of the curved plate 51 positioned above the first end 42A of the second support rod 42 such that the second support rod 42 is parallel with the Z direction (vertical direction) of the outer casing 33 when viewed in the axial line Ax direction (the state illustrated in FIG. 7).

With provision of the second support rods 42 having such a configuration, the second support rods 42 function as braces (support rods) between the inner surfaces 45*a*, 46*a* of the end plates 45, 46 and the inner surface 51*a* of the curved plate 51, making it possible to suppress deformation of the outer casing 33 (specifically, the end plates 45, 46 and the curved plate 51) in which the interior is in a vacuum state.

Further, with provision of the second support rods 42 having the configuration described above, when deformation occurs in which the end plates 45, 46 become recessed due to the pressure on the outer side of the outer casing 33 being higher than the pressure inside the outer casing 33, a force resulting from the deformation of the end plates 45, 46 can be transmitted to an upper portion of the curved plate 51 via the second support rods 42.

At this time, because the second support rods 42 are disposed parallel with the Z direction (vertical direction) of the outer casing 33 when viewed in the axial line Ax direction (refer to FIG. 6 and FIG. 7), the force transmitted to the curved plate 51 includes a lateral component (hereinafter referred to as "lateral component S2") that acts in a direction parallel with the axial line Ax direction, and an upward component (hereinafter referred to as "upward component U2") that acts in a direction that pushes the upper portion of the curved plate 51 upward.

Accordingly, the force transmitted from the second support rods 42 to the curved plate 51 does not include a component that acts in the direction from the second side in the lateral direction toward the first side in the lateral direction (a component that moves the outer casing 33 and the inner casing 31 to the exhaust port 56 side). As a result, displacement (displacement in the lateral direction) of the outer casing 33 and the inner casing 31 to the exhaust port 56 side caused by the provision of the second support rods 42 can be suppressed.

Note that, in FIGS. 5 to 7, description has been made using an example in which two second support rods 42 are provided inside the outer casing 33. The number of the second support rods 42 provided inside the outer casing 33, however, may be one or more, and is not limited to two. That is, the second support rod 42 may be provided on only one end plate of the pair of end plates 45, 46.

The third support rod 43 is a support rod that extends in one direction. Two of the third support rods 43 are provided inside the outer casing 33 with both ends connected to the inner surface of the outer casing 33.

First ends 43A of the two third support rods 43 are connected to an inner surface 53Aa of the upper portion 53A of the side plate 53. Second ends 43B of the two third support rods 43 are connected to the inner surface 48*a* of the ceiling plate 48 positioned on the second side in the lateral direction of the first end 43A of the third support rod 43. The two third support rods 43 are arranged in the X direction.

With provision of the third support rods 43 having the configuration described above, the third support rods 43 function as braces between the inner surface 53Aa of the upper portion 53A of the side plate 53 and the inner surface 48*a* of the ceiling plate 48, making it possible to suppress deformation of the outer casing 33 (specifically, the side plate 53 and the ceiling plate 48) in which the interior is in a vacuum state.

Further, with provision of the third support rods 43 having the configuration described above, when the upper portion 53A of the side plate 53 deforms recessed toward the curved plate 51 side due to the pressure on the outer side of the outer casing 33 being higher than the pressure inside the outer casing 33, a force resulting from the deformation of the upper portion 53A of the side plate 53 can be transmitted to the ceiling plate 48 connected to the second ends 43B of the third support rods 43 via the first ends 43A of the third support rods 43.

At this time, the force transmitted to the ceiling plate 48 includes a lateral component (hereinafter referred to as "lateral component S3") that acts in a direction from the first side in the lateral direction toward the second side in the lateral direction of the outer casing 33, and an upward component (hereinafter referred to as "upward component U3") that acts in a direction that pushes the ceiling plate 48 upward.

Thus, with the upward component U3 of the force transmitted to the ceiling plate 48, it is possible to suppress deformation in which the ceiling plate 48 becomes recessed due to the pressure on the outer side of the outer casing 33.

Further, a force generated when the steam inside the outer casing 33 is discharged via the exhaust ports 56 (specifically, the force that attempts to move the outer casing 33 and the inner casing 31 in a direction from the second side in the lateral direction toward the first side in the lateral direction of the outer casing 33) can be weakened by the lateral component S3 of the force transmitted to the ceiling plate 48.

That is, with provision of the third support rods 43 having the configuration described above, deformation of the outer casing 33 is suppressed, making it possible to suppress displacement of the outer casing 33 and the inner casing 31 in the lateral direction toward the exhaust port 56.

Note that, in FIGS. 5 to 7, description has been made using an example in which two third support rods 43 are provided inside the outer casing 33. The number of the third support rods 43 provided inside the outer casing 33, however, may be one or more, and is not limited to two.

As the first to third support rods 41 to 43 described above, for example, a rod made of a metal (carbon steel, for example) can be used. Further, as a method for connecting both ends (the first ends 41A to 43A and the second ends 41B to 43B) of the first to third support rods 41 to 43 to the inner surface of the outer casing 33, welding can be used, for example. Note that, instead of welding, a rod with a flange may be fixed by bolts.

Next, with reference to FIG. 1, description is made of the generator 19. The generator 19 is fixed on the turbine frame 25. The generator 19 houses a portion of the turbine rotor 18. The generator 19 generates power by a rotational energy of the turbine rotor 18.

Figure 8:
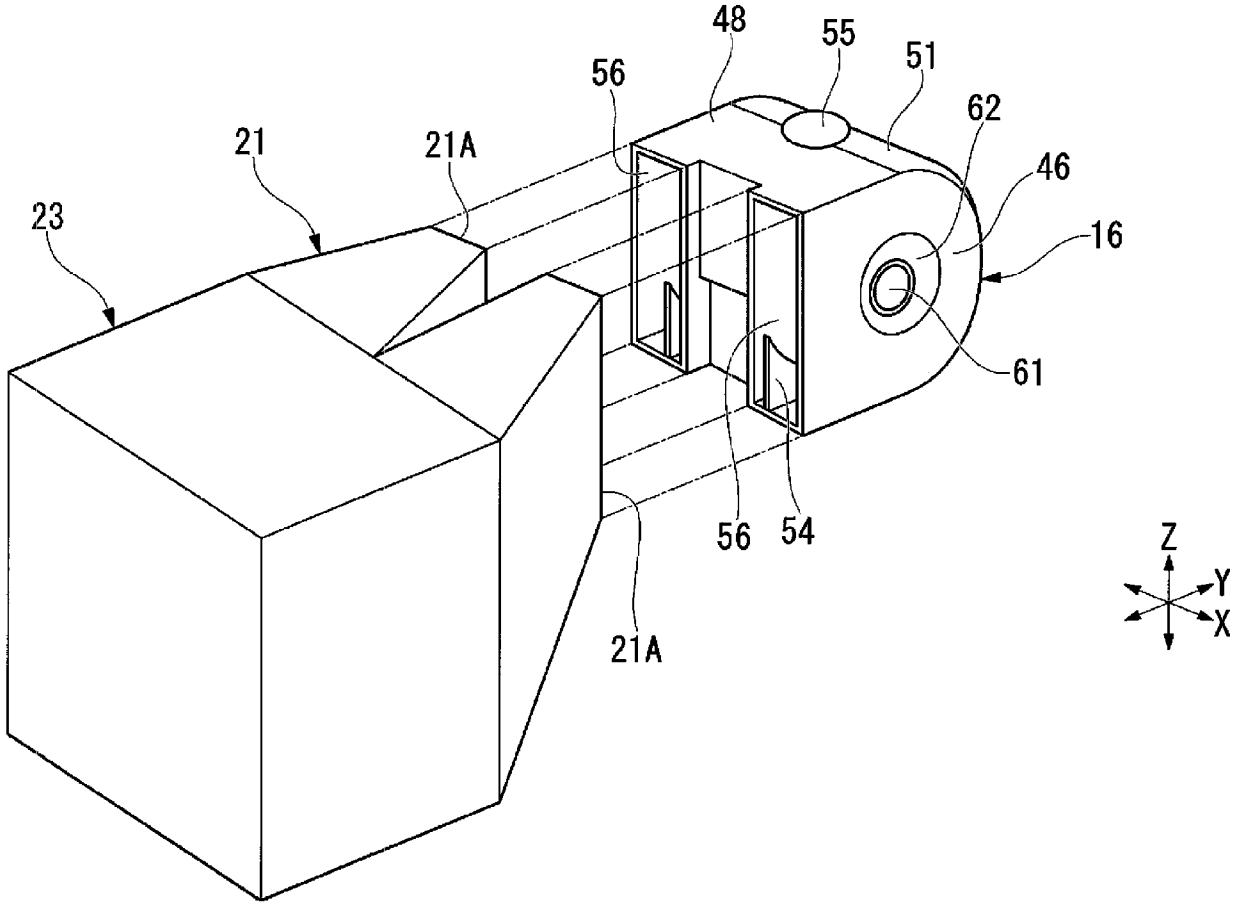
FIG. 8 is a perspective view schematically illustrating the low-pressure steam turbine illustrated in FIG. 2 and an intermediate shell in a separated state.

Next, the intermediate shell 21 will be described with reference to FIG. 2 and FIG. 8. In FIG. 8, common reference signs are assigned to similar components to the structural bodies illustrated in FIG. 2. Further, in FIG. 8, the expandable member 22 illustrated in FIG. 2 is not illustrated.

The intermediate shell 21 is provided between the low-pressure steam turbine 16 and the condenser 23. The intermediate shell 21 is a member extending in the Y direction. The intermediate shell 21 includes an inflow port 21A, an outflow port 21B, and a flow channel 21C.

Two of the inflow ports 21A are provided on the side facing the low-pressure steam turbine 16. The two inflow ports 21A are arranged in the X direction. The two inflow ports 21A each face one exhaust port 56 in the Y direction. The inflow port 21A is connected to the exhaust port 56 of the outer casing 33 via the expandable member 22 having a frame shape. The steam guided from the inner casing 31 into the outer casing 33 is discharged into the inflow port 21A.

The outflow port 21B is provided on the side facing the condenser 23. The outflow port 21B is in communication with the inflow port 21A via the flow channel 21C. The outflow port 21B is connected with the condenser 23. Steam that has passed through the outflow port 21B is supplied into the condenser 23.

The flow channel 21C is disposed inside the intermediate shell 21. The flow channel 21C connects the inflow port 21A and the outflow port 21B, and is a channel for allowing the steam to flow therethrough.

The condenser 23 is disposed on the first side in the lateral direction of the outer casing 33 of the low-pressure steam turbine 16. The condenser 23 is mounted on a support surface 1.

The condenser 23 draws heat from the steam supplied from the low-pressure steam turbine 16 via the intermediate shell 21, thereby liquefying the steam and generating water.

The water produced by the condenser 23 is returned to the steam generator 11 and reused.

Note that, in the first embodiment, a case has been described in which the condenser 23 is disposed on the first side in the lateral direction of the outer casing 33 of the low-pressure steam turbine 16, but the condenser 23 may be disposed on both sides in the lateral direction of the outer casing 33.

Next, the turbine frame 25 will be described with reference to FIGS. 1 to 3. The turbine frame 25 is fixed on the support surface 1 (on a floor surface of a building, for example).

The turbine frame 25 supports the high-pressure steam turbine 13, the low-pressure steam turbine 16, and the generator 19, and regulates the positions thereof. A recess 25A for housing a portion of a lower portion of the outer casing 33 is formed in a central portion of the turbine frame 25. The recess 25A includes a bottom surface 25Aa that faces the bottom plate 47 of the outer casing 33.

The turbine frame 25 includes the support portion 25B that extends upward from the bottom surface 25Aa and is inserted into the insertion portion 53C of the outer casing 33. The support portion 25B functions to support the outer casing 33 housed in the recess 25A.

Examples of a material of the turbine frame 25 include concrete and reinforced concrete. Further, the turbine frame 25 may be at least partially made of steel.

According to the steam turbine system 10 of the first embodiment, the first support rods 41 described above are provided, making it possible to cause the first support rods 41 to function as braces between the inner surfaces 45*a*, 46*a* of the end plates 45, 46 and the inner surface 48*a* of the ceiling plate 48.

As a result, deformation of the outer casing 33 (specifically, the end plates 45, 46 and the ceiling plate 48) in which the interior is in a vacuum state can be suppressed.

Further, with provision of the first support rods 41 having the configuration described above, when deformation occurs in which the end plates 45, 46 become recessed due to the pressure on the outer side of the outer casing 33 being higher than the pressure inside the outer casing 33, a force resulting from the deformation of the end plates 45, 46 can be transmitted to the ceiling plate 48 connected to the second ends 41B of the first support rods 41 via the first ends 41A of the first support rods 41.

At this time, because the second ends 41B of the first support rods 41 are disposed on the second side in the lateral direction of the outer casing 33 than the first ends 41A of the first support rods 41, the force transmitted to the ceiling plate 48 includes the lateral component S1 that acts in a direction from the first side in the lateral direction toward the second side in the lateral direction of the outer casing 33, and the upward component U1 that acts in a direction that pushes the curved plate 51 upward.

Thus, with the upward component U1 of the force transmitted to the ceiling plate 48, it is possible to suppress deformation in which the ceiling plate 48 becomes recessed due to the pressure on the outer side of the outer casing 33.

Further, a force generated when the steam inside the outer casing 33 is discharged via the exhaust ports 56 (specifically, the force that attempts to move the outer casing 33 and the inner casing 31 in a direction from the second side in the lateral direction toward the first side in the lateral direction of the outer casing 33) can be weakened by the lateral component S1 of the force transmitted to the ceiling plate 48.

That is, according to the steam turbine system 10 of the first embodiment, with provision of the first support rods 41 having the configuration described above, deformation of the outer casing 33 is suppressed, making it possible to suppress displacement of the outer casing 33 and the inner casing 31 in the lateral direction toward the exhaust ports 56.

Note that, in the first embodiment, an example has been given of a case in which the first to third support rods 41 to 43 are provided as support rods connected to the inner surface of the outer casing 33, but the second and third support rods 42, 43 need only be provided as necessary, and are not required.

Further, inside the outer casing 33, the first support rods 41 and the second support rods 42 may be disposed in combination, or the first support rods 41 and the third support rods 43 may be disposed in combination.

Further, a plurality of ribs may be provided on the outer surface of the outer casing 33 from the perspective of reinforcing the outer casing 33.

In this case, preferably the first ends 41A, 42A of the first and second support rods 41, 42 are connected to the inner surfaces 45*a*, 46*a* of the end plates 45, 46 corresponding to the intersection of the ribs.

Second Embodiment

Figure 9:
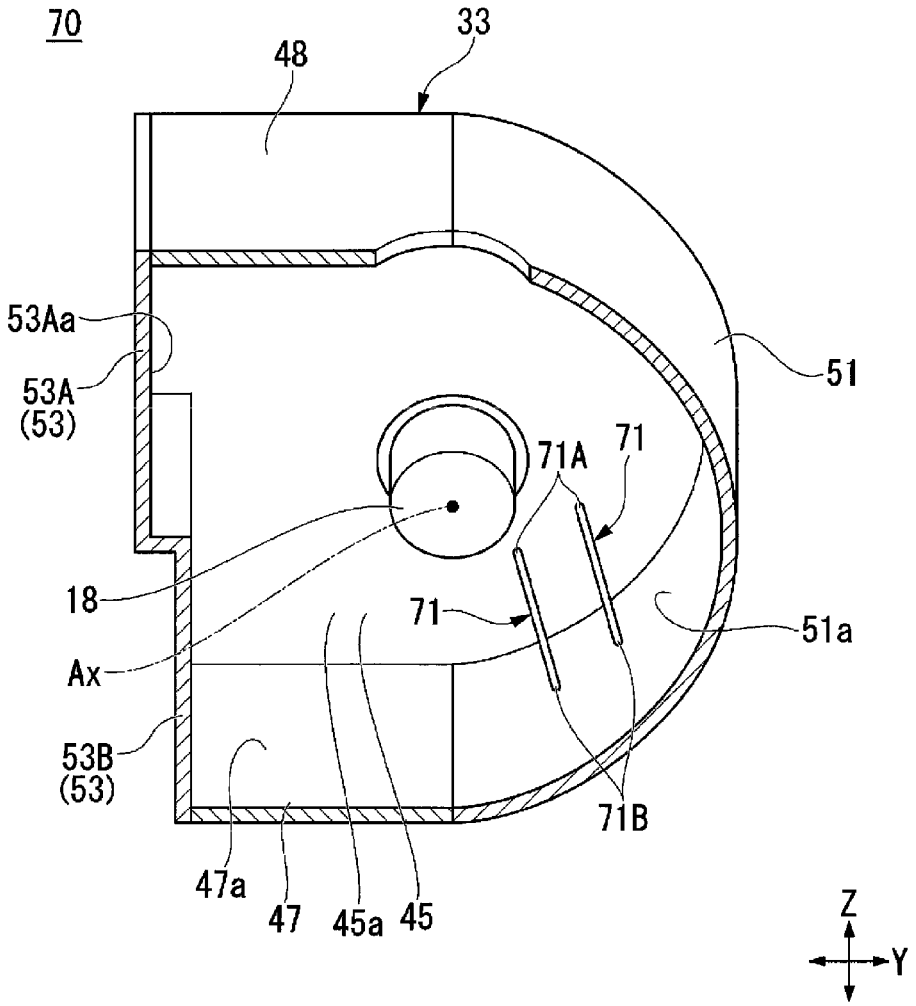
FIG. 9 is a diagram (diagram 1) for explaining a first support rod included in the steam turbine system according to a second embodiment of the present invention, and is a cross-sectional perspective view of an outer casing schematically illustrating a state in which the first support rod is provided to a first end plate.
Figure 10:
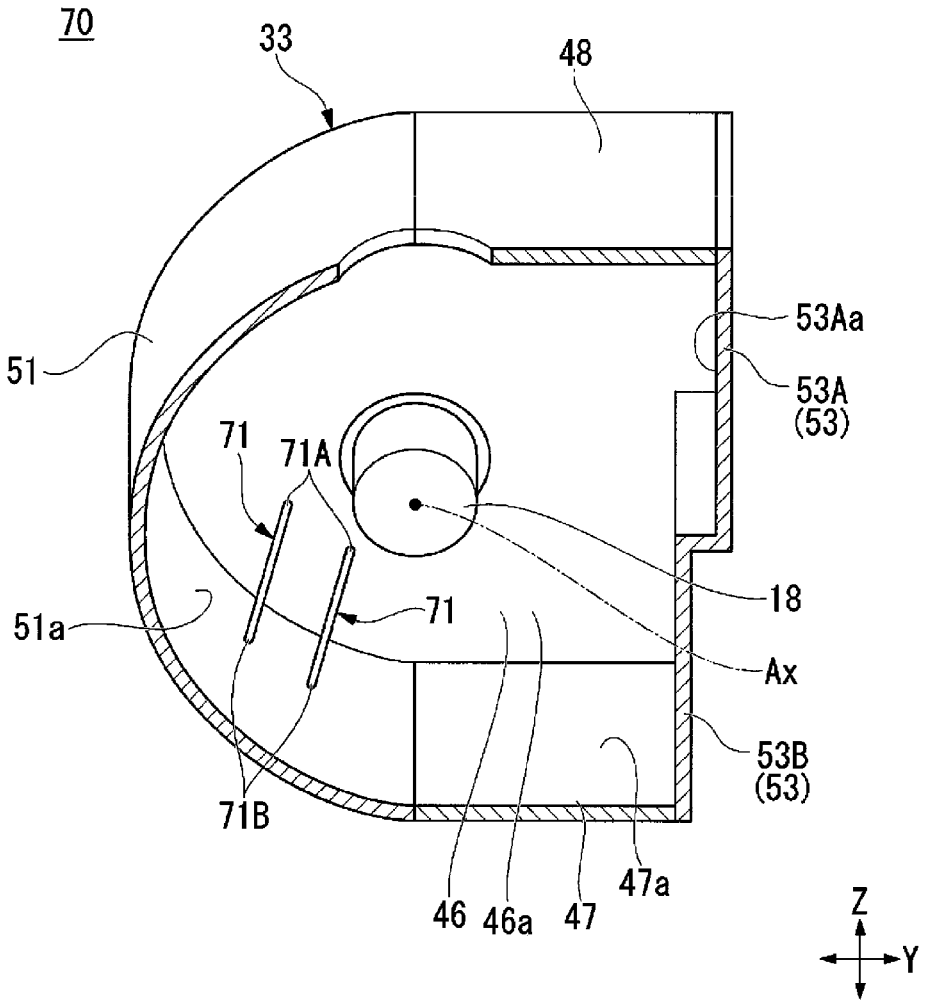
FIG. 10 is a diagram (diagram 2) for explaining the first support rod included in the steam turbine system according to the second embodiment of the present invention, and is a cross-sectional perspective view of the outer casing schematically illustrating the first support rod provided to a second end plate.
Figure 11:
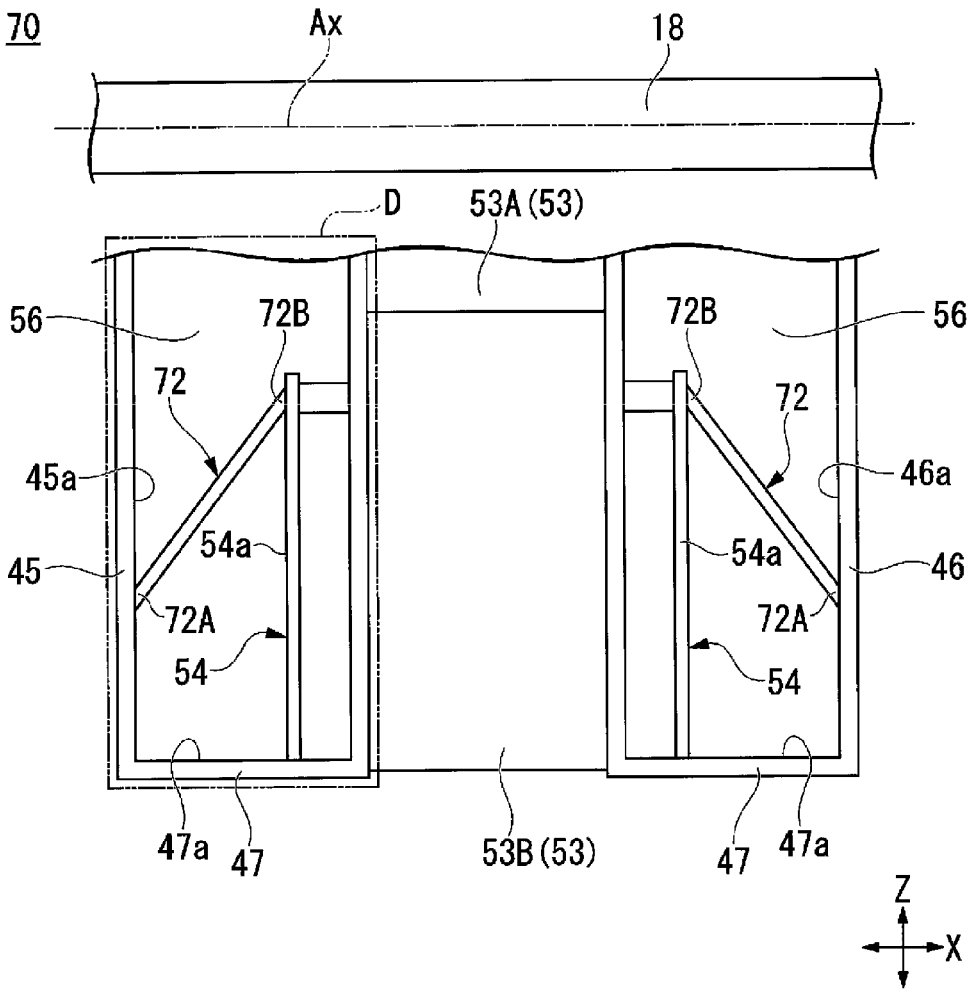
FIG. 11 is a diagram illustrating a second support rod included in the steam turbine system according to the second embodiment of the present invention, and is an enlarged view of a lower portion of an exhaust port and a lower portion of a side plate of the outer casing.
Figure 12:
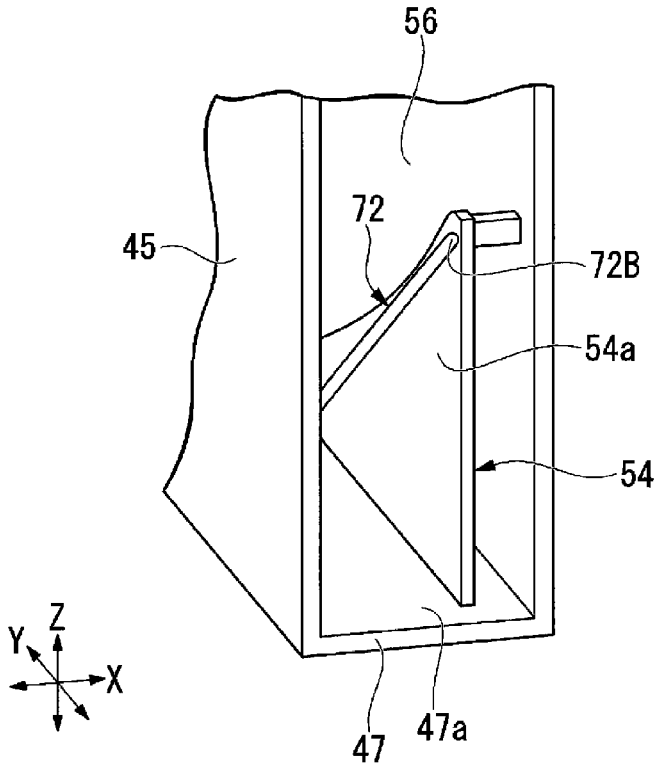
FIG. 12 is an enlarged perspective view of a region D of the structural body illustrated in FIG. 11.

A steam turbine system 70 of a second embodiment will be described with reference to FIG. 9 to FIG. 13. FIG. 9 to FIG. 11 illustrate only some of the constituent components included in the steam turbine system 70. In FIG. 9 to FIG. 13, common reference signs are assigned to similar components to the structural bodies illustrated in FIG. 1 to FIG. 8 previously described. Further, in FIG. 9 to FIG. 13, the same reference signs are used for the constituent components that are the same.

The steam turbine system 70 of the second embodiment has the same configuration as the steam turbine system 10 except that the steam turbine system 70 includes first and second support rods 71, 72 instead of the first to third support rods 41 to 43 included in the steam turbine system 10 of the first embodiment.

The first support rod 71 extends in one direction, and four first support rods 71 are provided inside the outer casing 33. First ends 71A of the two first support rods 71 are connected to a surface, of the inner surface 45*a* of a lower half of the end plate 45, on the second side in the lateral direction of the axial line Ax of the turbine rotor 18 (refer to FIG. 9).

Second ends 71B of these two first support rods 71 are disposed further on the second side in the lateral direction of the outer casing 33 than the first ends 71A of the first support rods 71, and connected to the inner surface 51*a* of the curved plate 51 positioned below the first ends 71A of the first support rods 71.

The first ends 71A of the remaining two first support rods 71 are connected to a surface, of the inner surface 46*a* of a lower half of the end plate 46, on the second side in the lateral direction of the axial line Ax of the turbine rotor 18 (refer to FIG. 10).

The second ends 71B of these remaining two first support rods 71 are connected to the inner surface 51*a* of the curved plate 51 disposed further on the second side in the lateral direction of the outer casing 33 than the first ends 71A of the first support rods 71, and positioned below the first ends 71A of the first support rods 71 (refer to FIG. 10).

However, in a state in which the bottom plate 47 of the outer casing 33 is fixed to the turbine frame 25 illustrated in FIG. 1, a fixed portion of the bottom plate 47 and the turbine frame 25 is a constraint point. Then, moments centered on the constraint point are generated in the outer casing 33 in this state.

Specifically, a moment is generated in a direction from bottom to top on the curved plate 51 side, a moment is generated in a direction from top to bottom on the exhaust port 56 side, and a moment is generated in a direction from the second end in the lateral direction toward the first end in the lateral direction on the ceiling plate 48 side.

With provision of the first support rods 71 having the configuration described above, when the end plates 45, 46 are deformed recessed due to the pressure on the outer side of the outer casing 33 being higher than the pressure inside the outer casing 33, a force resulting from the deformation of the end plates 45, 46 can be transmitted to the lower portion of the curved plate 51 connected to the second ends 71B of the first support rods 71 via the first ends 71A of the first support rods 71.

At this time, the force transmitted to the lower end of the curved plate 51 includes a lateral component (hereinafter referred to as "lateral component S4") that acts in a direction from the first side in the lateral direction toward the second side in the lateral direction, and a downward component (hereinafter referred to as "downward component D1") that acts in a direction that pushes the curved plate 51 downward.

Thus, with the downward component D1 of the force transmitted to the lower portion of the curved plate 51, it is possible to suppress deformation in which the lower portion of the curved plate 51 becomes recessed, and offset a portion of the moment in the direction from bottom to top generated on the curved plate 51 side.

Further, a force generated when the steam inside the outer casing 33 is discharged via the exhaust ports 56 (specifically, the force that attempts to move the outer casing 33 and the inner casing 31 (refer to FIG. 4) in a direction from the second side in the lateral direction toward the first side in the lateral direction of the outer casing 33) can be weakened by the lateral component S4 of the force transmitted to the lower portion of the curved plate 51.

That is, with provision of the first support rods 71 having the configuration described above, deformation of the outer casing 33 is suppressed, making it possible to suppress displacement of the outer casing 33 and the inner casing 31 in the lateral direction toward the exhaust ports 56.

Note that, in the second embodiment, description has been made using an example in which four first support rods 71 are provided inside the outer casing 33. The number of the first support rods 71 provided inside the outer casing 33, however, may be one or more, and is not limited to four. That is, the first support rod 71 may be provided on only one end plate of the pair of end plates 45, 46.

The second support rod 72 extends in one direction, and two second support rods 72 are provided inside the outer casing 33. A first end 72A of one of the second support rods 72 is connected to a surface, of the inner surface 45*a* of the lower half of the end plate 45, on the first side in the lateral direction of the axial line Ax of the turbine rotor 18.

A second end 72B of one of the second support rods 72 is connected to the opposing surface 54*a* of the reinforcement rib 54 further on the second side in the lateral direction of the outer casing 33 than the first ends 72A of the second support rods 72, and positioned above the first ends 72A of the second support rods 72.

The first end 72A of other of the second support rods 72 is connected to a surface, of the inner surface 46*a* of the lower half of the end plate 46, on the first side in the lateral direction of the axial line Ax of the turbine rotor 18.

The second end 72B of the other second support rods 72 is connected to the opposing surface 54*a* of the reinforcement rib 54 further on the second side in the lateral direction of the outer casing 33 than the first ends 72A of the second support rods 72, and positioned above the first ends 72A of the second support rods 72.

Thus, with provision of the second support rods 72 having the configuration described above, the second support rods 72 function as braces between the inner surfaces 45*a*, 46*a* of the lower half of the end plates 45, 46 and the opposing surface 54*a* of the reinforcement rib 54, making it possible to suppress deformation of the outer casing 33 (specifically, the end plates 45, 46) in which the interior is in a vacuum state.

Further, with provision of the second support rods 72 having the configuration described above, when the end plates 45, 46 are deformed recessed due to the pressure on the outer side of the outer casing 33 being higher than the pressure inside the outer casing 33, a force resulting from the deformation of the end plates 45, 46 can be transmitted to the reinforcement rib 54 connected to the second ends 72B of the second support rods 72 via the first ends 72A of the second support rods 72.

At this time, the force transmitted to the reinforcement rib 54 includes a lateral component that acts in a direction from the first side in the lateral direction toward the second side in the lateral direction, and an upward component that acts in a direction that pushes the reinforcement rib 54 upward.

Thus, it is possible to reduce the moment in the direction from the top to the bottom that occurs on the exhaust port 56 side by the upward component of the force transmitted to the reinforcement rib 54.

Further, a force generated when the steam inside the outer casing 33 is discharged via the exhaust ports 56 (specifically, the force that attempts to move the outer casing 33 and the inner casing 31 (refer to FIG. 4) in a direction from the second side in the lateral direction toward the first side in the lateral direction of the outer casing 33) can be weakened by the lateral component of the force transmitted to the reinforcement rib 54.

That is, with provision of the second support rods 72 having the configuration described above, deformation of the outer casing 33 is suppressed, making it possible to suppress displacement of the outer casing 33 and the inner casing 31 in the lateral direction toward the exhaust ports 56.

Note that, in the second embodiment, description has been made using an example in which two second support rods 72 are provided inside the outer casing 33. The number of the second support rods 72 provided inside the outer casing 33, however, may be one or more, and is not limited to two. That is, the second support rod 72 may be provided on only one end plate of the pair of end plates 45, 46.

Examples of the first and second support rods 71, 72 described above include a rod made of a metal such as carbon steel. Further, to connect both ends (the first ends 71A, 72A and the second ends 71B, 72B) of the first and second support rods 71, 72 and the inner surface of the outer casing 33, welding can be used, for example. Note that, instead of welding, a rod with a flange may be fixed by bolts.

Next, inclinations of the first and second support rods 71, 72 will be described with reference to FIG. 13.

Figure 13:
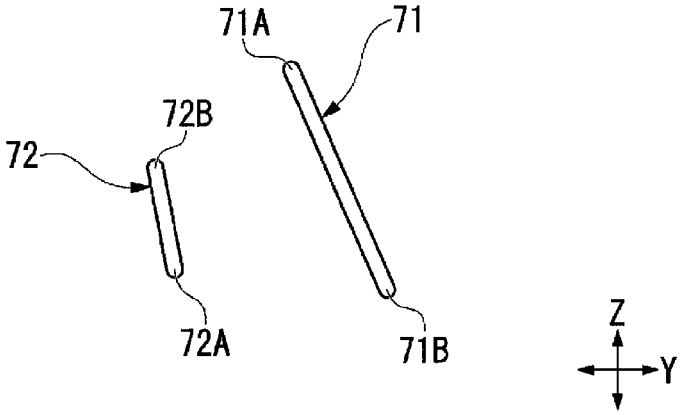
FIG. 13 is a diagram schematically illustrating the first and second support rods as viewed in the axial line direction.

FIG. 13 is a diagram of the first and second support rods 71, 72 disposed on the end plate 45 side as viewed in the axial line Ax direction. In FIG. 13, common reference signs are assigned to similar components to the structural bodies illustrated in FIGS. 9 and 11.

As illustrated in FIG. 13, the second support rod 72 may be inclined more gently than an inclination of the first support rod 71 when viewed in the axial line Ax direction. Thus, by making the inclinations of the second support rods 72 connected at the first ends 72A to the inner surfaces 45*a*, 46*a* of the end plates 45, 46 more gentle than the inclination of the first support rods 71 connected at the first ends 71A to the inner surface 51*a* of the lower half of the curved plate 51, it is possible to efficiently reduce the moments generated on the curved plate side and the exhaust port side.

Thus, according to the steam turbine system 70 of the second embodiment, by providing the first support rods 71 described above, it is possible to suppress deformation in which the lower portion of the curved plate 51 becomes recessed, and offset a portion of the moment in the direction from bottom to top generated on the curved plate 51 side by the downward component of the force transmitted to the lower portion of the curved plate 51 via the first support rods 71.

Further, a force generated when the steam inside the outer casing 33 is discharged via the exhaust ports 56 (specifically, the force that attempts to move the outer casing 33 and the inner casing 31 (refer to FIG. 4) in a direction from the second side in the lateral direction toward the first side in the lateral direction of the outer casing 33) can be weakened by the lateral component of the force transmitted to the lower portion of the curved plate 51.

That is, with provision of the first support rods 71 having the configuration described above, deformation of the outer casing 33 is suppressed, making it possible to suppress displacement of the outer casing 33 and the inner casing 31 in the lateral direction toward the exhaust ports 56.

Note that, in the second embodiment, description has been made using an example in which the first and the second support rods 71, 72 are provided inside the outer casing 33. The second support rod 72, however, is not required, and may be provided as necessary.

Further, a plurality of ribs may be provided on the outer surface of the outer casing 33 from the perspective of reinforcing the outer casing 33.

In this case, preferably the first ends 71A of the first support rods 71 and the first ends 72A of the second support rods 72 are connected to the inner surfaces of the end plates 45, 46 corresponding to the intersection of the ribs.

Further, the first support rod 41 described in the first embodiment may be applied as the third support rod, and the second support rod 42 described in the first embodiment may be applied as a fourth support rod to the steam turbine system 70 of the second embodiment. Furthermore, the third support rod 43 described in the first embodiment may be applied as a fifth support rod to the steam turbine system 70 of the second embodiment.

In this way, by applying at least one of the third support rods 41 to 43 described in the first embodiment to the steam turbine system 70 of the second embodiment, the same effects as those described in the first embodiment can be obtained.

Although preferable embodiments of the present invention have been described above in detail, the present invention is not limited to those specific embodiments. Various modifications and changes can be made to the embodiments without departing from the scope and spirit of the present invention described in the claims.

For example, the first support rod 71 described in the second embodiment may be applied as the fourth support rod to the steam turbine system 10 of the first embodiment. In this case, the same effects as those of the first support rod 71 described in the second embodiment can be obtained.

Further, the second support rod 72 described in the second embodiment may be applied as the fifth support rod to the steam turbine system 10 of the first embodiment. In this case, the same effects as those of the second support rod 72 described in the second embodiment can be obtained.

INDUSTRIAL APPLICABILITY

The present invention is applicable to a steam turbine system.

REFERENCE SIGNS LIST

1 Support surface
10, 70 Steam turbine system
11 Steam generator
12 Steam supply line
12A Diverging line
13 High-pressure steam turbine
14 Moisture separation heater
15A, 15B Line
16 Low-pressure steam turbine
18 Turbine rotor
19 Generator
21 Intermediate shell
21A Inflow port
21B Outflow port
21C Flow channel
22 Expandable member
23 Condenser
25 Turbine frame
25A Recess
25Aa Bottom surface
25B Support portion
31 Inner casing
31A Steam introduction port
31B, 33A Space
33 Outer casing
41, 71 First support rod
41A, 42A, 43A, 71A, 72A First end
41B, 42B, 43B, 71B, 72B Second end
42, 72 Second support rod
43 Third support rod
45, 46 End plate
45*a*, 46*a*, 47*a*, 48*a*, 51*a*, 53Aa Inner surface
47 Bottom plate
48 Ceiling plate
51 Curved plate
53 Side plate
53A Upper portion
53B Lower portion
53C Insertion portion
54 Reinforcement rib
54*a* Opposing surface
55, 61 Opening
56 Exhaust port
62 Cone portion
Ax Axial line

The invention claimed is:

1. A steam turbine system comprising:

a steam turbine provided with a rotor that rotates about an axial line and extends in a horizontal direction, an inner casing that houses the rotor and allows steam to be introduced therein, and an outer casing that houses the inner casing, the outer casing being provided with an exhaust port on a first side in a lateral direction, and being in a vacuum state in an interior thereof;

a condenser disposed on the first side in the lateral direction of the outer casing and supplied with the steam via the exhaust port; and a first support rod provided inside the outer casing and extending in one direction, the outer casing including an end plate facing the inner casing in an axial line direction serving as an extending direction of the axial line of the rotor, a ceiling plate disposed above the inner casing, extending along a horizontal plane, and connected to the end plate, a bottom plate disposed below the ceiling plate, extending along the horizontal plane, and connected to the end plate, and a curved plate facing the exhaust port in a direction intersecting the axial line, protruding in a direction separating from the exhaust port, and connected to an end of the ceiling plate and an end of the bottom plate disposed on a second side in the lateral direction of the outer casing, as well as the end plate, and the first support rod including a first end connected to a surface, of an inner surface of an upper half of the end plate, positioned on the first side in the lateral direction of the axial line, and a second end connected to an inner surface of the ceiling plate disposed further on the second side in the lateral direction of the outer casing than the first end.

2. The steam turbine system according to claim 1, further comprising:

a second support rod provided inside the outer casing, extending in one direction, and including a first end connected to a surface, of the inner surface of the upper half of the end plate, positioned on the second side in the lateral direction of the axial line, and a second end connected to an inner surface of the curved plate positioned above the first end of the second support rod such that the second support rod is parallel with a vertical direction of the outer casing when viewed in an axial line direction.

3. The steam turbine system according to claim 1, further comprising:

a third support rod provided inside the outer casing and extending in one direction, the outer casing facing the curved plate in a direction intersecting the axial line, and further including a side plate connected to an end of the ceiling plate and an end of the bottom plate disposed on the first side in the lateral direction, as well as the end plate, and the third support rod including a first end connected to an inner surface of the side plate, and a second end connected to an inner surface of the ceiling plate positioned on the second side in the lateral direction of the first end of the third support rod.

4. The steam turbine system according to claim 1, further comprising:

a turbine frame disposed below the outer casing and configured to fix the bottom plate; and a fourth support rod provided inside the outer casing, extending in one direction, and including a first end connected to a surface, of an inner surface of a lower half of the end plate, positioned on the second side in the lateral direction of the axial line of the rotor, and a second end disposed further on the second side in the lateral direction of the outer casing than the first end of the fourth support rod and connected to an inner surface of the curved plate positioned below the first end of the fourth support rod.

5. The steam turbine system according to claim 4, further comprising:

a turbine frame disposed below the outer casing and configured to fix the bottom plate; and a fifth support rod provided inside the outer casing and extending in one direction, the outer casing including a reinforcement rib that protrudes upward from the bottom plate and includes an opposing surface facing an inner surface of the end plate, and the fifth support rod including a first end connected to a surface, of an inner surface of a lower half of the end plate, on the first side in the lateral direction of the axial line, and a second end connected to the opposing surface of the reinforcement rib positioned further on the second end side in the lateral direction of the outer casing than the first end of the fifth support rod, and above the first end of the fifth support rod.

6. The steam turbine system according to claim 5, wherein the fifth support rod is inclined more gently than an inclination of the fourth support rod when viewed in the axial line direction.

7. A steam turbine system comprising:

a steam turbine provided with a rotor that rotates about an axial line and extends in a horizontal direction, an inner casing that houses the rotor and allows steam to be introduced therein, and an outer casing that houses the inner casing, the outer casing being provided with an exhaust port on a first side in a lateral direction, and being in a vacuum state in an interior thereof;

a condenser disposed on the first side in the lateral direction of the outer casing and supplied with the steam via the exhaust port;

a turbine frame that supports the outer casing; and a first support rod provided inside the outer casing and extending in one direction, the outer casing including an end plate facing the inner casing in an axial line direction serving as an extending direction of the axial line of the rotor, a ceiling plate disposed above the inner casing, extending along a horizontal plane, and connected to the end plate, a bottom plate disposed below the ceiling plate, extending along the horizontal plane, and connected to the end plate, and a curved plate facing the exhaust port in a direction intersecting the axial line of the rotor, protruding in a direction separating from the exhaust port, and connected to an end of the ceiling plate and an end of the bottom plate disposed on a second side in the lateral direction of the outer casing, as well as the end plate, and the first support rod including a first end connected to a surface, of an inner surface of a lower half of the end plate, positioned on the second side in the lateral direction of the axial line of the rotor, and a second end disposed further on the second side in the lateral direction of the outer casing than the first end of the first support rod, and connected to an inner surface of the curved plate positioned below the first end of the first support rod.

8. The steam turbine system according to claim 7, further comprising:

a second support rod provided inside the outer casing, and extending in one direction, the outer casing further including a reinforcement rib protruding upward from the bottom plate and including an opposing surface facing the inner surface of the end plate, and the second support rod including a first end connected to a surface, of an inner surface of a lower half of the end plate, on the first side in the lateral direction of the axial line, and a second end connected to the opposing surface of the reinforcement rib positioned further on the second side in the lateral direction of the outer casing than the first end of the second support rod, and above the first end of the second support rod.

9. The steam turbine system according to claim 8, wherein the second support rod is inclined more gently than an inclination of the first support rod when viewed in the axial line direction.

10. The steam turbine system according to claim 7, further comprising:

a third support rod provided inside the outer casing, extending in one direction, and including a first end connected to a surface, of an inner surface of an upper half of the end plate, on the first side in the lateral direction of the axial line of the rotor, and a second end connected to an inner surface of the ceiling plate disposed further on the second side in the lateral direction of the outer casing than the first end.

11. The steam turbine system according to claim 7, further comprising:

a fourth support rod provided inside the outer casing, extending in one direction, and including a first end connected to a surface, of an inner surface of an upper half of the end plate, on the second side in the lateral direction of the axial line, and a second end connected to an inner surface of a lower half of the curved plate such that the fourth support rod is parallel with the vertical direction of the outer casing when viewed in the axial line direction.

12. The steam turbine system according to claim 7, further comprising:

a fifth support rod provided inside the outer casing and extending in one direction, the outer casing further including a side plate facing the curved plate and connected to an end of the ceiling plate disposed on the first side in the lateral direction, an end of the bottom plate disposed on the first side in the lateral direction, and the end plate, and the fifth support rod including a first end connected to an inner surface of the side plate, and a second end connected to an inner surface of the ceiling plate positioned on the second side in the lateral direction of the first end of the fifth support rod.

13. The steam turbine system according to claim 1, wherein two of the end plates are disposed facing each other in the axial line direction across the inner casing.

14. The steam turbine system according to claim 1, wherein the outer casing includes a side plate facing the exhaust port in a direction intersecting the axial line, two of the exhaust ports are provided in the axial line direction, and the side plate is disposed between the two exhaust ports.

15. The steam turbine system according to claim 7, wherein two of the end plates are disposed facing each other in the axial line direction across the inner casing.

16. The steam turbine system according to claim 7, wherein the outer casing includes a side plate facing the exhaust port in a direction intersecting the axial line, two of the exhaust ports are provided in the axial line direction, and the side plate is disposed between the two exhaust ports.

* * * * *